US009752372B2

(12) United States Patent
Arendsee

(10) Patent No.: US 9,752,372 B2
(45) Date of Patent: Sep. 5, 2017

(54) EQUIPMENT SECURITY ENCLOSURE

(71) Applicant: Wayne C. Arendsee, Fort Worth, TX (US)

(72) Inventor: Wayne C. Arendsee, Fort Worth, TX (US)

( * ) Notice: Subject to any disclaimer, the term of this patent is extended or adjusted under 35 U.S.C. 154(b) by 0 days.

(21) Appl. No.: 15/236,460

(22) Filed: Aug. 14, 2016

(65) Prior Publication Data

US 2016/0376827 A1 Dec. 29, 2016

Related U.S. Application Data

(63) Continuation of application No. 13/544,677, filed on Jul. 9, 2012, now abandoned.

(51) Int. Cl.

| | |
|---|---|
| ***E05G 1/024*** | (2006.01) |
| ***B65D 85/68*** | (2006.01) |
| ***B65D 6/08*** | (2006.01) |
| ***B65D 25/24*** | (2006.01) |

(Continued)

(52) U.S. Cl.

CPC ..... *E05G 1/024* (2013.01); *B65D 7/16* (2013.01); *B65D 25/24* (2013.01); *B65D 55/14* (2013.01); *B65D 85/68* (2013.01); *E05G 1/04* (2013.01); *B65D 2211/00* (2013.01);

(Continued)

(58) Field of Classification Search

CPC ..... B65D 85/68; B65D 2211/00; B65D 2585/6812; B65D 25/24; B65D 7/16; B65D 55/14; E05B 67/36; E05B 67/38; E05B 67/383; F24F 13/20; F24F 2013/202; F24F 2013/205; F24F 1/02; E05G 1/024; E05G 1/026; E05G 1/04; E05Y 2800/426; Y10T 70/5009

USPC ... 70/32, 54–56, 163, 164, 166–173, 18, 58; 109/50–52, 58, 64, 73, 78, 79; 52/3, 23; 220/4.28, 4.31; 312/213, 236

See application file for complete search history.

(56) References Cited

U.S. PATENT DOCUMENTS

| | | | | |
|---|---|---|---|---|
| 86,189 | A * | 1/1869 | Sullivan | E05G 1/00 109/79 |
| 3,731,956 | A * | 5/1973 | Hanley | B65D 9/12 217/13 |
| 4,548,330 | A | 10/1985 | Hewitt et al. | |

(Continued)

*Primary Examiner* — Lloyd Gall
(74) *Attorney, Agent, or Firm* — John Lindsay

(57) ABSTRACT

An exemplary security enclosure for equipment has four substantially planar side panels with multiple engagement openings and is received on a surface. The panels have a generally square cross-section and have engagement protrusions along an edge that engage engagement openings in an adjacent panel or an interposed connector frame. A top panel is engaged across the upper end of the side panels using the same inter-fitting engagement protrusion and engagement opening pairing, which together with the surface, completely enclose the equipment. A tang is fixedly attached to one of the side panels and extends through the top panel. A puck lock receives engages an opening in the tang with a hasp that is completely enclosed within the lock, preventing relative motion of the panels. A surface mount include legs section extending downwardly from a side panel and present a downwardly oriented face, the face having an opening. A fastener dimensioned to slideably engage through the opening secure the security enclosure to the surface.

14 Claims, 32 Drawing Sheets

(51) Int. Cl.
*B65D 55/14* (2006.01)
*E05G 1/04* (2006.01)

(52) U.S. Cl.
CPC . *B65D 2585/6812* (2013.01); *E05Y 2800/426* (2013.01); *Y10T 70/5009* (2015.04)

(56) References Cited

U.S. PATENT DOCUMENTS 4,559,881 A * 12/1985 Lankard ..... B28B 23/00 106/644
4,566,237 A * 1/1986 Turner ..... E04H 9/10 109/1 S
4,587,788 A * 5/1986 Bielicki ..... E04B 1/6137 256/59
4,643,107 A * 2/1987 Gunn ..... G07F 9/06 109/48
5,322,365 A * 6/1994 Teufel ..... A47B 88/0407 220/351
5,350,304 A * 9/1994 Fula ..... G09B 19/00 312/213
5,375,440 A * 12/1994 Patterson ..... B65D 55/14 206/317
5,822,936 A * 10/1998 Bateman ..... E04H 9/10 109/1 R
5,992,955 A * 11/1999 Yang ..... E05C 19/06 220/4.31
6,010,166 A 1/2000 Hamilton et al.
6,158,175 A * 12/2000 Carter ..... F24F 1/58 52/23
6,430,954 B1 * 8/2002 Smith ..... F24F 1/58 135/913
6,497,018 B1 * 12/2002 Chiu ..... A61G 17/00 220/4.28
6,581,424 B2 * 6/2003 Oliver ..... E05G 1/005 109/58
6,595,017 B1 * 7/2003 Teahan ..... F24F 1/50 52/71
6,754,992 B1 * 6/2004 Byfield ..... E04B 1/2403 403/205
7,004,344 B2 * 2/2006 Fulton ..... B65D 11/1873 220/324
7,047,774 B1 5/2006 Gogel
7,147,125 B1 * 12/2006 Slovak ..... B65D 81/3818 220/4.31
7,162,898 B2 1/2007 Gogel
7,761,963 B2 * 7/2010 Koch ..... A61G 17/00 220/4.28
8,357,031 B2 * 1/2013 Dinicolas ..... F24F 13/20 454/201
8,510,998 B1 * 8/2013 Martinez ..... F24F 1/58 52/3
8,677,790 B2 3/2014 Ramsey
8,807,609 B2 * 8/2014 Stallbaumer ..... E05B 67/36 292/1
2001/0037611 A1 * 11/2001 Cornett, Sr. ..... E04B 7/02 52/23
2002/0020706 A1 * 2/2002 Smith ..... B65D 88/121 220/210
2004/0173610 A1 9/2004 Gracia
2005/0056062 A1 * 3/2005 Gogel ..... E05B 13/001 70/56
2006/0180059 A1 8/2006 Martin
2007/0130841 A1 * 6/2007 Bays ..... E04B 1/02 52/3
2007/0215616 A1 9/2007 Chen et al.
2009/0249842 A1 10/2009 Coon
2010/0018966 A1 * 1/2010 Roberts, Sr. ..... B65D 19/18 220/4.31
2010/0108669 A1 * 5/2010 Yang ..... B65D 11/1873 220/4.31
2011/0309072 A1 * 12/2011 Rio Gonzalez ..... B31B 17/00 220/4.28

* cited by examiner

EQUIPMENT SECURITY ENCLOSURE

PRIORITY

The present invention claims priority to nonprovisional application Ser. No. 13/544,677, which has a filing date of Jul. 9, 2012, now abandoned.

BACKGROUND

Field of the Invention

The present invention relates to security devices, more specifically to security enclosures for surface mounted equipment.

Description of the Related Art

Equipment theft and theft of equipment components (particularly copper components) has become an increasing problem. In a typical theft thieves will strip air conditioning equipment of all the copper parts including tubing, destroying the equipment in the process. Experienced thieves can strip a ground or roof mounted air conditioning condenser of virtually all of the copper content in 5 minutes or less. The speed with which the equipment can be dismantled makes ordinary security measures such as alarm systems valueless because the thieves will be long gone before law enforcement personnel can reach the scene.

Due to the frequency and magnitude of losses, various devices have been proposed, described and in some cases sold. Many of these devices are based on the same basic approach, which is to enclose the equipment in a cage with openings for ventilation.

Prior art devices suffer from unique and common deficiencies. For example, prior art cages that are of sufficient strength to resist common burglar tools such as bolt cutters and wire cutters, are extremely heavy. When the construction is unitary (all 3 or 4 sides and a top welded or otherwise permanently secured together), they cannot be lifted by manpower alone. In some devices the cages are mounted on pivots so that they can be swung over the equipment and laid to rest on the roof substrate or, in the case of ground mounted equipment, they merely are laid on the ground. Even with the pivot mounts, the weight may be so great that it takes more than one person to pivot the cage out of the way for servicing or replacement of the equipment increasing the required number of workers which increases costs.

At the opposite extreme, where the cage is relatively light weight, it is common for thieves to merely pry the cage apart at the corners, or to use bolt cutters to cut through the bars forming the cage to expose at least one side of the equipment and provide access to remove the copper components. In some cases the lightweight bars telescope to make the enclosure adjustable to fit various sizes and shapes of equipment. Once one side of the cage is breeched, the remaining sides can be easily slipped apart. The motivation for such adjustable designs includes the fact that it is very expensive to buy the tooling to make multiple cages of different sizes. This is brought about by the fact that these designs do not lend themselves to low cost manufacturing techniques such as modern high speed cutting techniques including laser, water-jet or plasma cutters. The designs incorporating tubing also do not lend themselves to low cost forming techniques such as bending brakes. As a consequence it requires new tooling to make custom designs and cannot be accomplished by a mere programming change in computer aided manufacturing (CAM) software.

Another problem arises due to the necessity of locking the cage to the skid, in the case of roof mounted air conditioning equipment, or a concrete pad, in the case of ground mounted equipment. Typically, the locks used are conventional padlocks which are easily defeated with bolt cutters because the hasp of the lock is exposed.

In other cases, the thieves may find it easiest merely to unbolt the cage from its base. In many cases the bolts and nuts can be reached and removed by conventional tools. Where security fasteners are employed they typically require special tools that the owner must employ to remove the security fasteners. These tools are frequently misplaced between servicing intervals which results in inconvenience, delay and expense for the owner. For the thief most of these tools are readily available in the market place. Thieves frequently have these tools more readily at hand than does the owner.

SUMMARY

An exemplary embodiment of a security enclosure for equipment has a plurality of substantially planar side panels joined to define a perimeter. Each of the side panels has one of engagement protrusions or engagement openings along it side edges. In order to join the side panels, the adjacent side panel has the reciprocal portion of the engagement protrusion/engagement opening pair along its side edge. The upper end of the side panels also includes one of engagement protrusions or engagement openings along it side edges. One of the side panels includes a tang extending outwardly.

A top panel dimensioned to span across the perimeter defined by the plurality of side panels. The top panel has the reciprocal portion of the engagement protrusion/engagement opening pair for securing to the upper end of the side panels. The top panel also includes an opening on its upper end through which the tang of the side panel can be slidably engaged.

In operation, the side panels are joined at their respective engagement protrusions and corresponding engagement openings pairs to define a side perimeter. The top panel is joined such that the tang of the side panel extends through the openings and at the upper end of the side panels at their respective engagement protrusions and corresponding engagement openings pairs to define a complete enclosed region. A lock is applied to an opening to prevent motion of the side panels and top panels relative to each other.

These and other features, aspects, and advantages of the invention will become better understood with reference to the following description, appended claims, and accompanying drawings.

DETAILED DESCRIPTION

While the foregoing detailed description has disclosed several embodiments of the invention, it is to be understood that the above description is illustrative only and not limiting of the disclosed invention. It will be appreciated that the discussed embodiments and other unmentioned embodiments may be within the scope of the invention.

Mechanical, electrical, or electronic equipment, such as air conditioning or other HVAC systems are mounted to a surface, subjecting it to theft. A mechanical unit 04 is secured to a surface such as the ground, a skid, roof, pad, or other surface. The current invention is directed to security enclosures 10 to restrict access to the mechanical unit 04.

Figure 1:
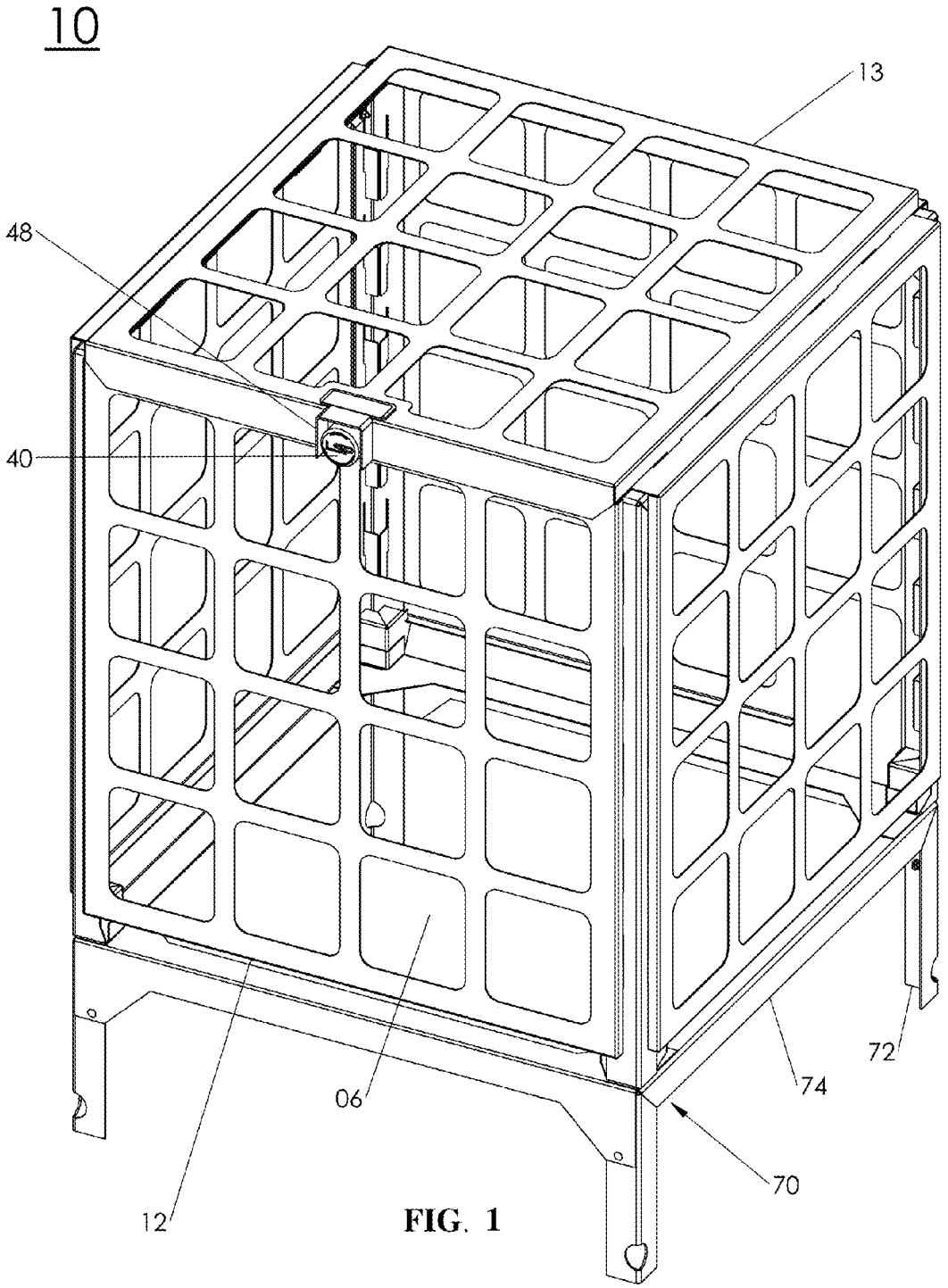
FIG. 1 is a perspective view of an embodiment of a security enclosure according to the current invention.
Figure 2:
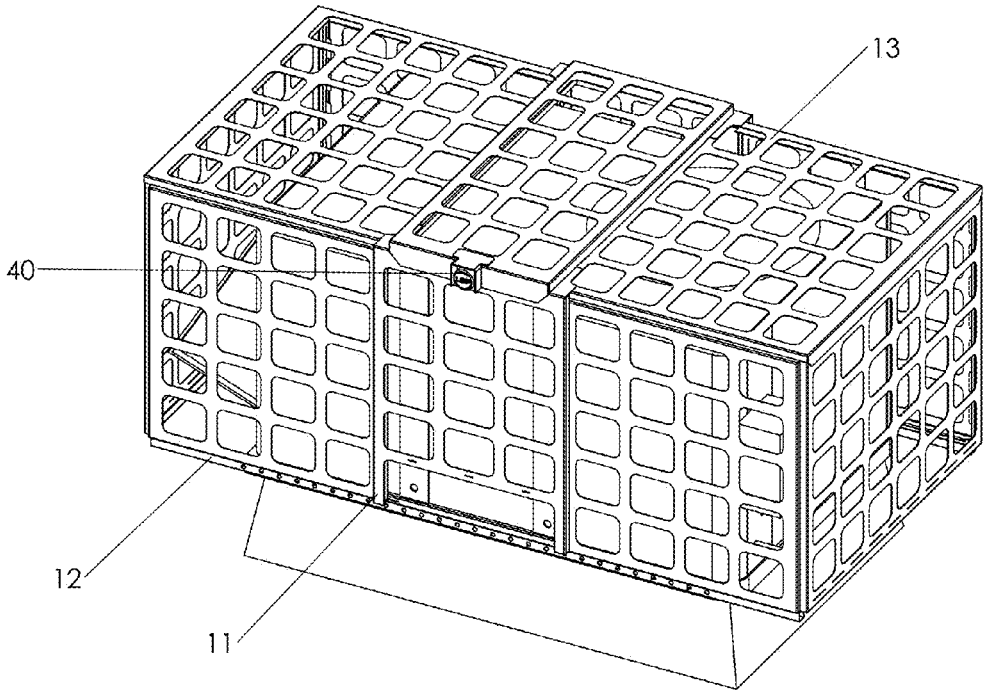
FIG. 2 is a perspective view of an alternate embodiment of a security enclosure according to the current invention.

FIGS. 1 and 2 illustrate embodiments of security enclosures 10 according to the current invention as they might exist in operation. Exemplary embodiments are modular so that a plurality of side panels 12 can be joined together to define a side perimeter around an enclosed region 06 in which equipment 04 will be secured. A top panel 13 is joined to the side panels 12 to encompass the enclosed region 06. The top panel 13 is securely joined with the side panels 12. The panels 12 13 have complementary inter-fitting protrusions and engagement openings so that once the panels 12 13 are joined, the security enclosure 10 cannot readily be disassembled without removing the top panel 13. A surface mount 70 secures the security enclosure 10 to the surface.

The illustrated security enclosures 10 depict a plurality of four joined side panels 12 to define the side perimeter. Exemplary side panels 12 are generally planar or have a generally planar cross-section and have a plurality of openings 16, enabling ventilation and visual access to the equipment 04 secured therein. The side panels 12 are composed of rigid material, such as metals. In exemplary embodiments, the side panels 12 are composed of sheet metal. The side panels 12 are dimensioned to present a side perimeter around the enclosed region 06 in which equipment 04 will be received. The side panels 12 extend from a lower end 18 to an upper end 17 and extend from a first edge 14 to a second edge 14. Although the illustrated side perimeter includes four side panels 12 in a square or rectangular geometry, other configurations can include other number of side panels 12, the side perimeter to such as three in a triangular geometry, six in a hexagonal geometry, or other regular or irregular geometries.

The illustrated security enclosures 10 depict a top panel 13, generally similar in composition and structure to the side panels 12. An exemplary top panel 13 is generally planar or has a generally planar cross-section and has a plurality of openings 16, enabling ventilation and visual access to the equipment 04 secured therein. The top panel 13 is composed of rigid material, such as metal. In exemplary embodiments, the top panel 13 is composed of sheet metal. The top panel 13 is dimensioned to span the upper ends 17 of the side panels 12, encompassing and further defining the enclosed region 06.

The panels 12 13 are joined together via engagement protrusions 20 and corresponding engagement openings 22. In order to join the panels, certain embodiment of the panels 12 13 include engagement protrusions 20 on one component 12 13 28 which are received in engagement openings 22 on an adjacent component 12 13 28. When the component 12 13 28 having the engagement protrusions 20 is slidably engaged to the adjacent component 12 13 28 so that the engagement protrusions 20 slide along the engagement openings 22, the engagement protrusions 20 are secured in position and cannot readily be removed.

Figure 7:
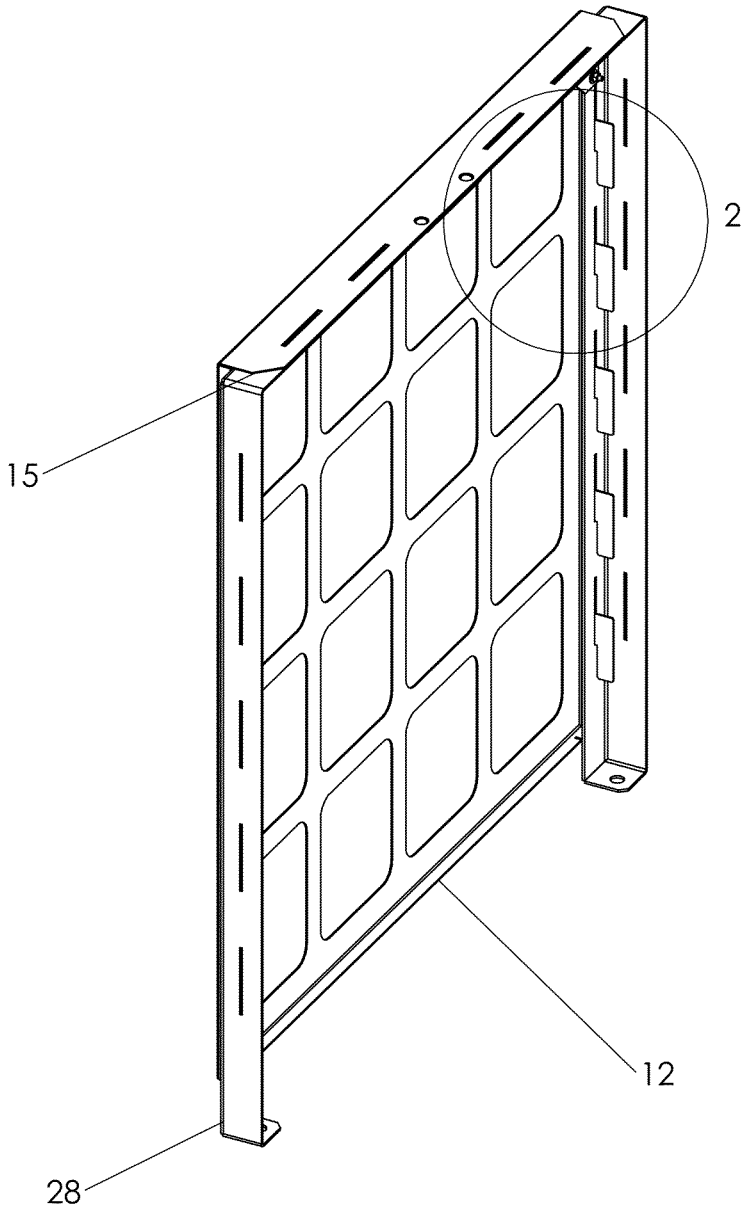
FIG. 7 shows a side panel engaged with a connector frame.
Figure 8:
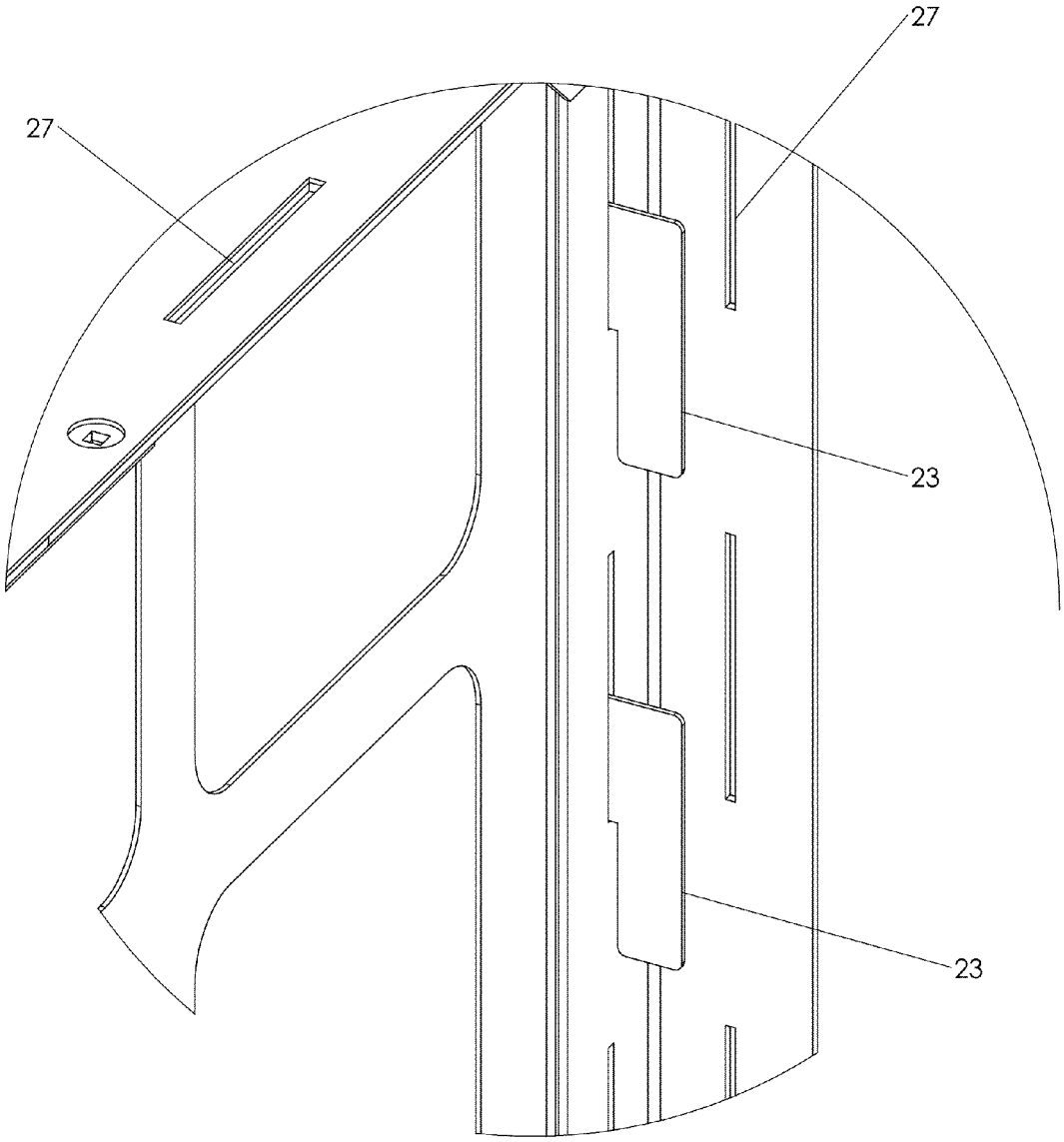
FIG. 8 shows a detailed view of a side panel engaged with a connector frame.

In certain configurations, such as those depicted in FIGS. 4 through 8, the engagement protrusions 20 are L-shaped hooks 23 and the engagement openings 22 are linear slots 27. In the L-shaped hook configuration, a first section 24 of the L-shaped hook 23 extends outwardly from the component 12 13 28 and a second section 25 of the L-shaped hook 23 angularly depends from the end of the first section 24. The exemplary angle relative to the first section 24 is about 90°, but suitable angles are those which restrict motion when engaged to the engagement opening 22. The corresponding engagement openings 22 of this configuration are linear slots 27. In FIG. 7 the "L-shaped" configuration of the hooks is apparent, while FIG. 8 shows the engagement of the L-shaped hooks 23 in the linear slots 27 in greater detail. The dotted lines indicate the motions that will first insert the L-shaped hook 23 into the linear slots 27 and then lower the L-shaped hook 23.

Figure 9:
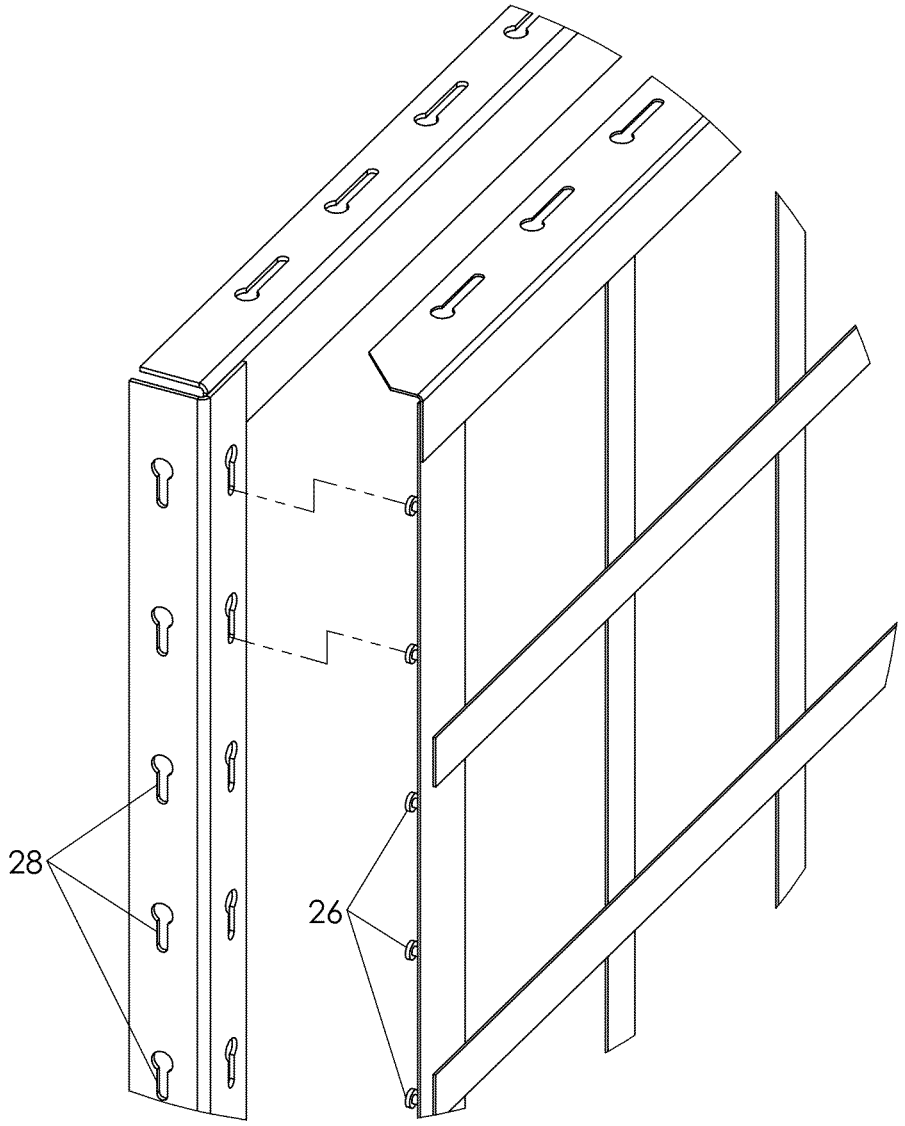
FIG. 9 shows an alternate side panel and a connector frame.
Figure 10:
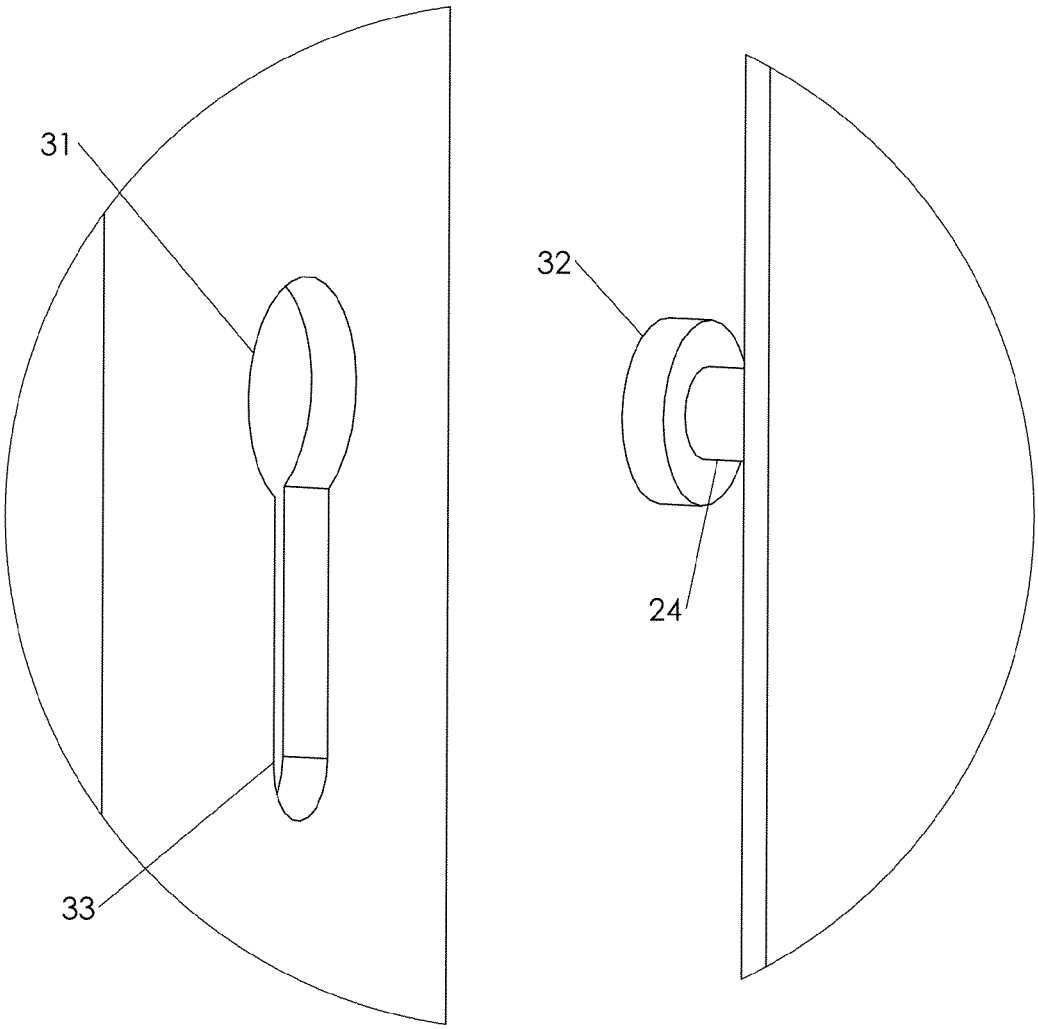
FIG. 10 shows a detailed view of the alternate side panel and a connector frame.

In certain configurations, such as that depicted in FIGS. 9 and 10, the engagement protrusions 20 are knob hooks 26 and the engagement openings 22 are keyhole slots 28. In the knob hook configuration, a first section 24 of the knob hook 26 of a first width extends outwardly from the component 12 13 28 and a second section 32 of the knob hooks 26 flares in width to a second greater width. The corresponding engagement openings 22 of this configuration are keyhole slots 28. The keyhole slots 28 have a first slot section 31 of a width greater than the flared second section of the knob hook 26. A second slot section 33, continuous with the first slot section 31, narrows to a width less than the flared second section of the knob hook 26. The knobs hooks 26 are inserted into the keyhole slots 28 and lowered so that the knob hook 26 is captured and cannot be removed once the enclosure is locked.

In various configurations, the engagement protrusions 20 of one component 12 13 28 the corresponding engagement openings 22 are deployed differently. In a first configuration, the engagement protrusions 20 and engagement openings 22 are included on the panels 12 13 and the panels 12 13 are engaged directly to each other. For example, one panel 12 13 has one of the engagement protrusions 20 or the engagement openings 22 and the second panel 12 13 has the corresponding section 20 22.

In certain configurations, the side edge 14 of one side panel 12 includes engagement protrusions 20 and the adjacent side edge 14 of the adjacent side panel 12 includes engagement opening 22. In certain configurations, the side edge 14 of one side panel 12 includes engagement protrusions 20 and engagement openings 22 with the adjacent side edge 14 of the adjacent side panel 12 includes reciprocally positioned engagement openings 22 and engagement protrusions 20. In certain configurations, the side edge 14 of one side panel 12 includes L-shaped hooks 23 and the adjacent side edge 14 of the adjacent side panel 12 includes linear slots 27. In certain configurations, the side edge 14 of one side panel 12 includes knob hooks 26 and the adjacent side edge 14 of the adjacent side panel 12 includes keyhole slots 28. It is within the scope of the invention to include other pairing combinations.

Figure 3:
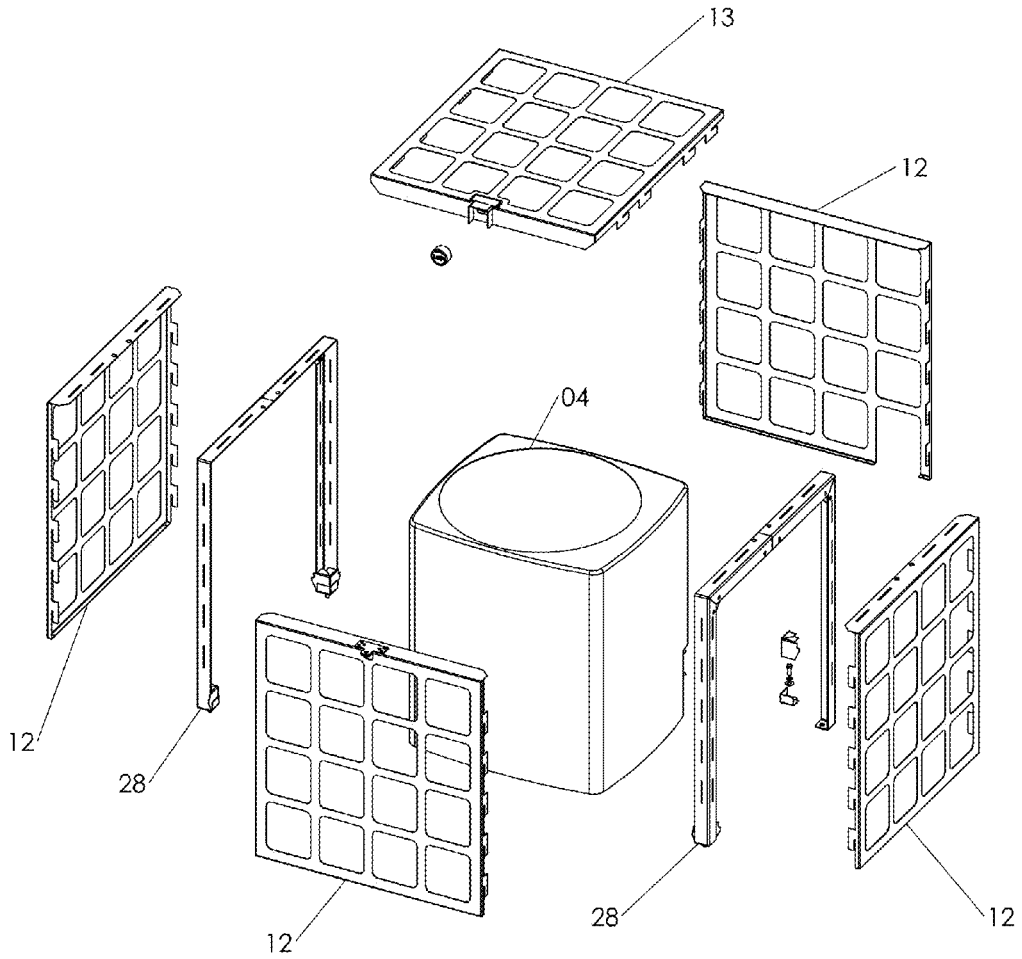
FIG. 3 is an exploded view of an embodiment of a security enclosure according to the current invention.
Figure 5:
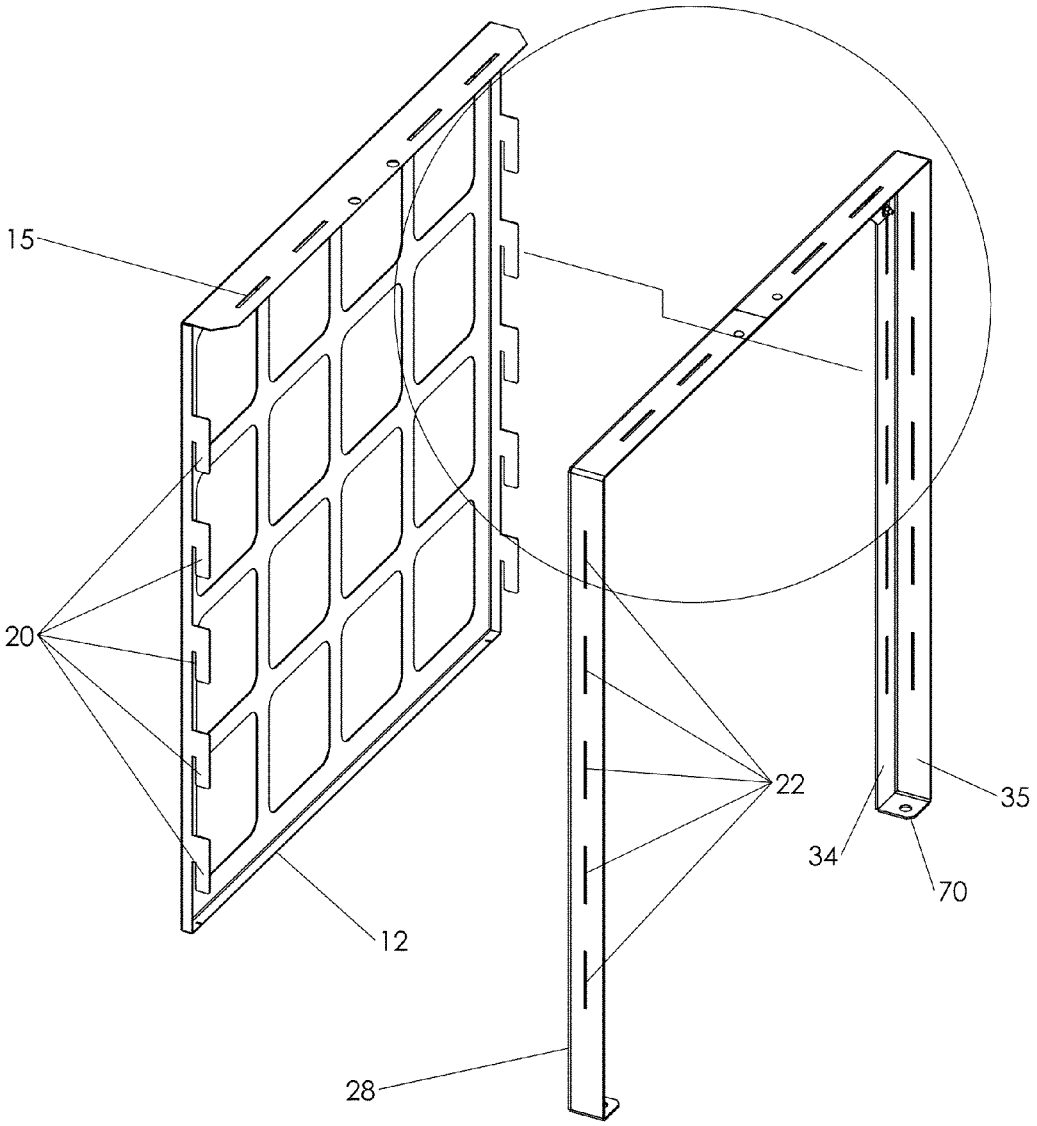
FIG. 5 shows a side panel and a connector frame.
Figure 6:
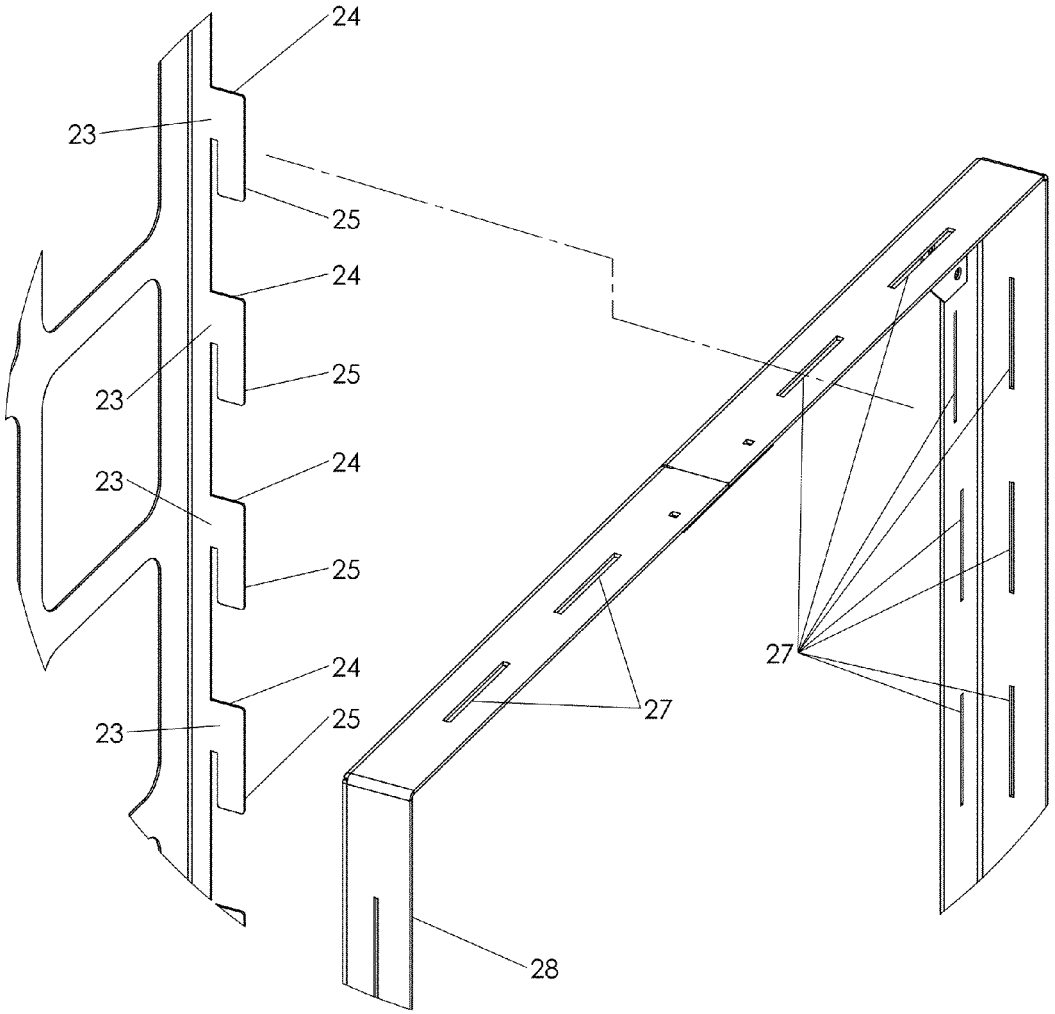
FIG. 6 shows a detailed view of a side panel and a connector frame.

FIGS. 3 and 5 illustrate a configuration where a connector frame 28 is included to be interposed between adjacent panels 12 13, bridging those adjacent panels 12 13. In this configuration, the connector frame 28 includes one of engagement protrusions 20 or engagement openings 22 on a first face 34 and one of engagement protrusions 20 or engagement openings 22 on a second face 35. One of the engagement protrusions 20 and engagement openings 22 are included on a first panel 12 13, and that panel 12 13 is engaged to the connector frame 28 on its first face 34. One of the engagement protrusions 20 and engagement openings 22 are included on a second panel 12 13, and that panel 12 13 is engaged to the connector frame 28 on its second face 35. For example, a side edge 14 of one panel 12 13 has one of the engagement protrusions 20 or the engagement openings 22 and the connector frame 28 has the reciprocal inter-fitting section 20 22.

In certain configurations, the side edge 14 of one side panel 12 includes engagement protrusions 20, the adjacent first face 34 of the connector frame 28 includes engagement openings 22, the second face 35 of the connector frame 28 includes engagement openings 22, and the adjacent side edge 14 of a second side panel 12 includes engagement protrusions 20. In certain configurations, the side edge 14 of one side panel 12 includes engagement openings 22, the adjacent first face 34 of the connector frame 28 includes engagement protrusions 20, the second face 35 of the connector frame 28 includes engagement protrusions 20, and the adjacent side edge 14 of a second side panel 12 includes engagement openings 22. In certain configurations, the side edge 14 of one side panel 12 includes L-shaped hooks 23, the adjacent first face 34 of the connector frame 28 includes linear slots 27, the second face 35 of the connector frame 28 includes linear slots 27, and the adjacent side edge 14 of a second side panel 12 includes L-shaped hooks 23. In certain configurations, the side edge 14 of one side panel 12 includes knob hooks 26, the adjacent first face 34 of the connector frame 28 includes keyhole slots 28, the second face 35 of the connector frame 28 includes keyhole slots 28, and the adjacent side edge 14 of a second side panel 12 includes knob hooks 26. It is within the scope of the invention to include other pairing combinations.

Figure 11:
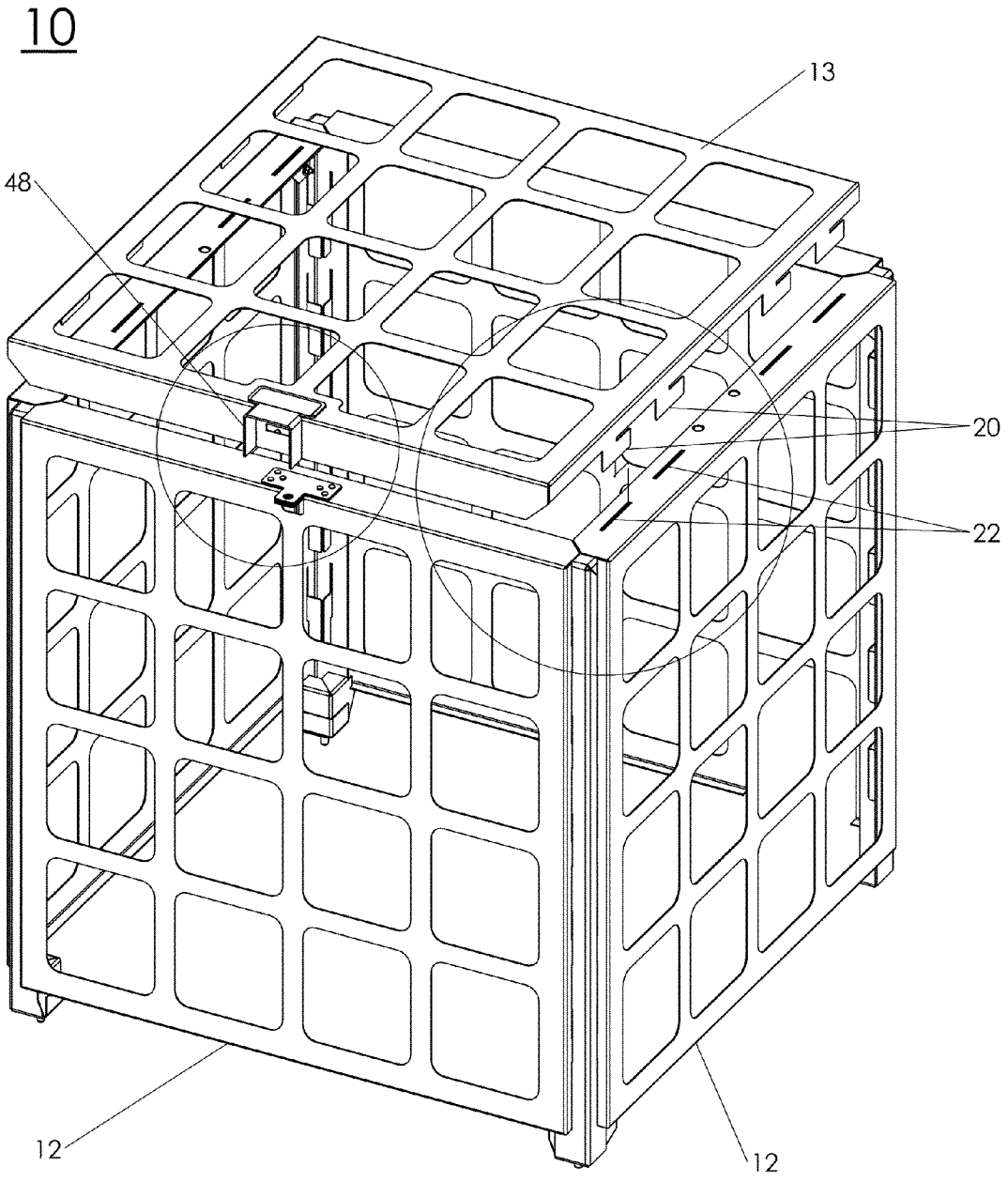
FIG. 11 shows an embodiment of a security enclosure in a partially enclosed state.
Figure 12:
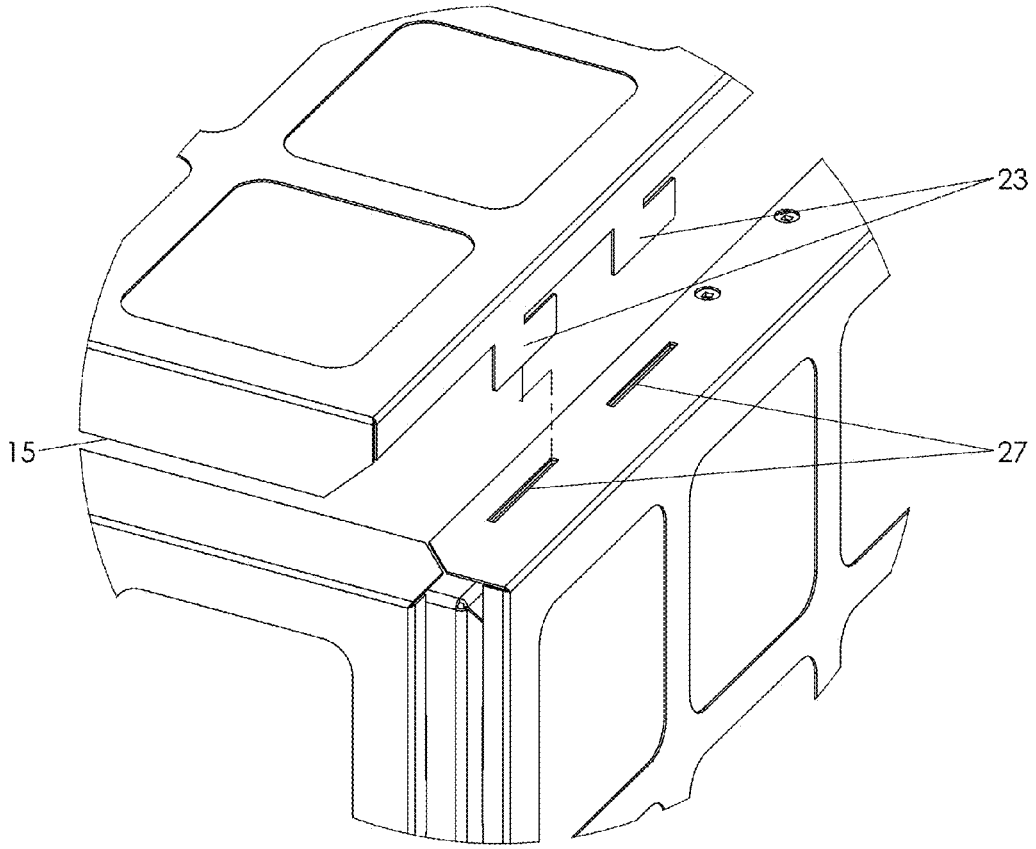
FIG. 12 is a detailed view of an engagement protrusions and engagement openings section of FIG. 11.
Figure 14:
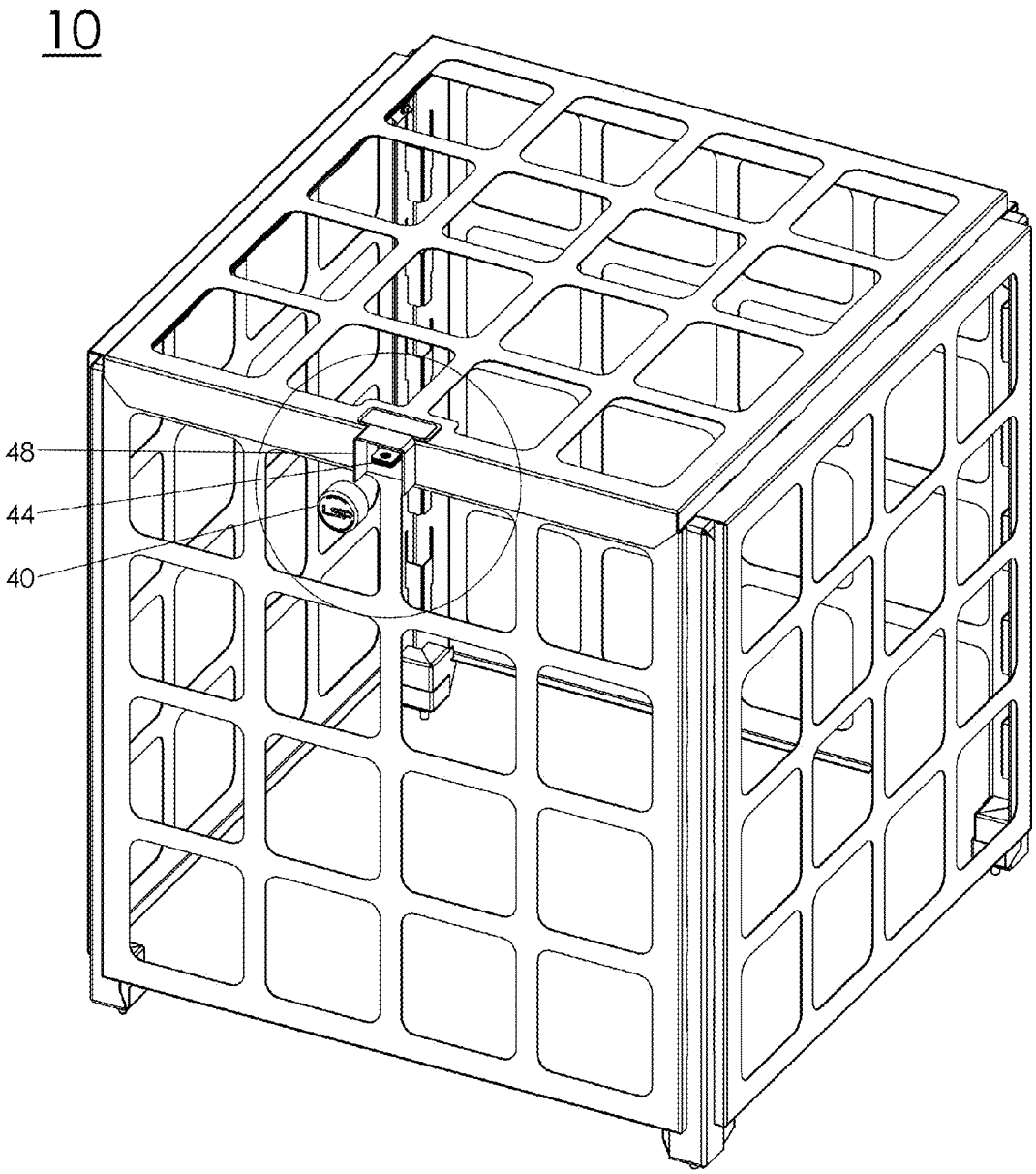
FIG. 14 shows an embodiment of a security enclosure in an enclosed state.

The top panel 13 is joined to the side panels 12 in a similar manner as the side panels 12 are joined. Namely, the top panels 12 13 include one of the engagement protrusions 20 and engagement openings 22. The engagement protrusion 20/engagement opening 22 pairs can be L-hook 23/linear slot 27 pairs or knob hook 26/keyhole slot 28 pairs previously disclosed. The reciprocal portion of the engagement protrusion 20/engagement opening 22 pair is included on a side panel 12 or connector frame 28. FIG. 11 shows a top panel 13 having L-hooks 23 in position to be inserted and slidable engaged to the linear slots 27 of a side panel 12. FIG. 12 shows the detail of area in FIG. 11 where the top panel 13 is slid in the linear slots 27 until the flange 15 abuts the side panel 12. FIG. 14 shows the security enclosure with the top panel 13 joined to the side panels 12. The enclosure region is completed by the top panel 13, which is generally similar to the side panels 12. Certain configurations of the top panel 13 includes a flange 15.

In certain configurations, the top edge 14 of one side panel 12 includes engagement protrusions 20 and an edge 14 of the top panel 13 includes engagement openings 22. In certain configurations, the top edge 14 of one side panel 12 includes engagement protrusions 20 and engagement openings 22, with the edge 14 of the top panel 13 including reciprocally positioned engagement openings 22 and engagement protrusions 20. In certain configurations, the top edge 14 of one side panel 12 includes L-shaped hooks 23 and the edge 14 of the top panel 13 includes linear slots 27. In certain configurations, the top edge 14 of one side panel 12 includes knob hooks 26 and the edge 14 of the top panel 13 includes keyhole slots 28. It is within the scope of the invention to include other pairing combinations.

Figure 13:
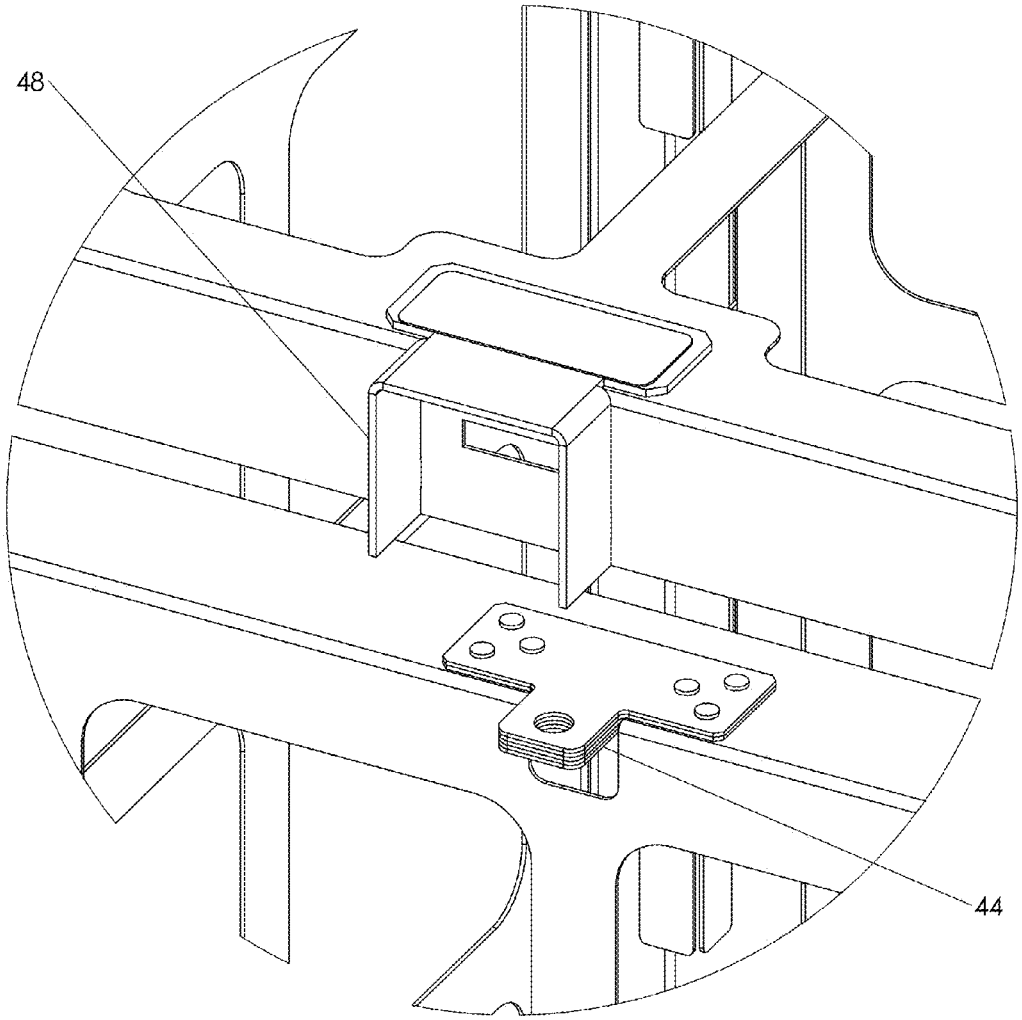
FIG. 13 is a detailed view of a top panel and side panel section.
Figure 15:
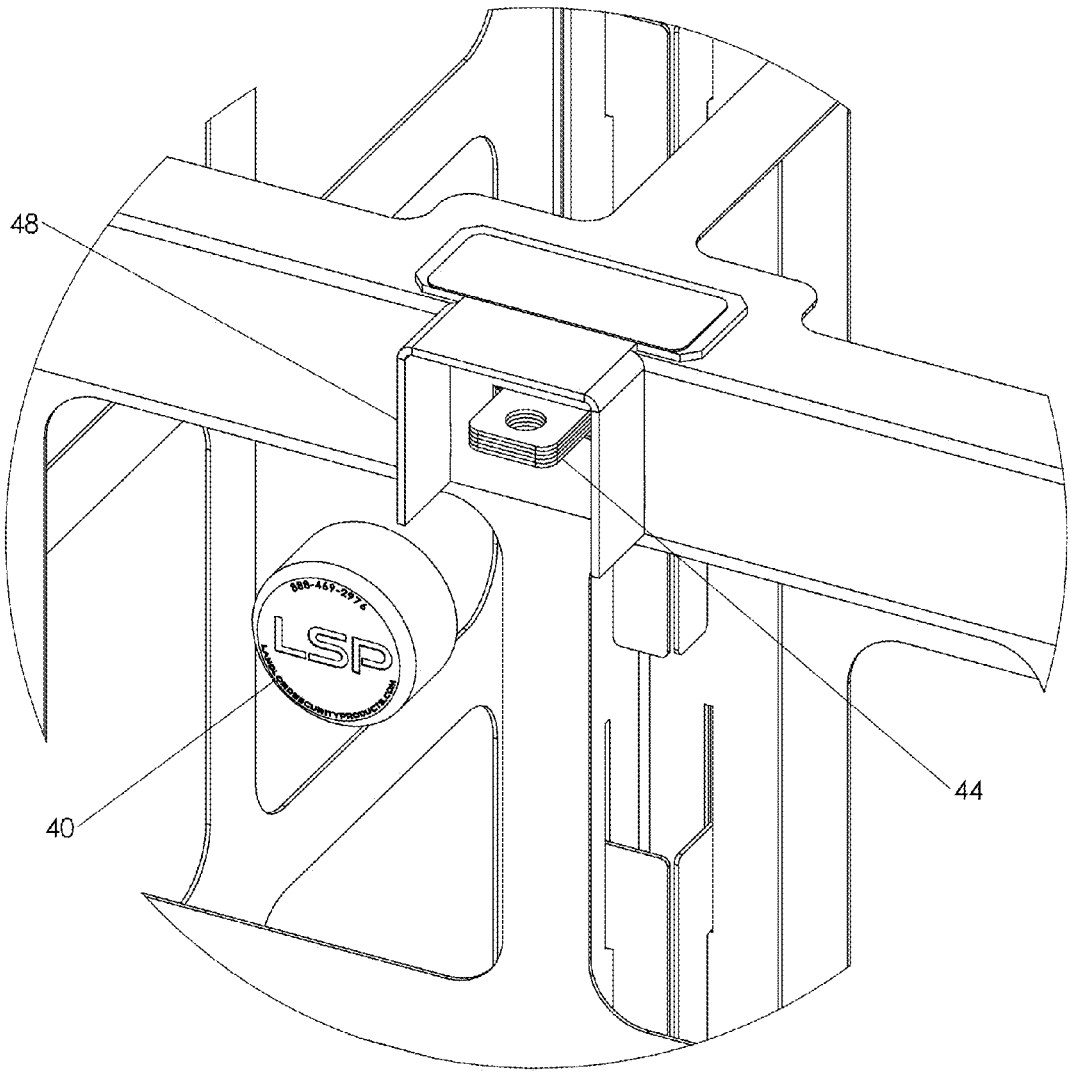
FIG. 15 shows a detailed view of the tang and lock section of FIG. 11.

FIGS. 13 through 15 illustrate a locking system, operable to restrict relative motion of the panels 12 13 to each other after the side panels 12 are joined and the top panel 13 is joined via the engagement protrusion 20/engagement opening 22 pairs, the security enclosure 10 further in a locking system. A tang 44 extends from a panel 12 13. The tang 44 is composed of high strength materials and structures which have sufficient tensile strength and resist bolt cutters, pry bars, and similar instruments. In exemplary configuration, the tang comprises multiple layers of sheet steel. The tang 44 includes an opening for slidable receipt of a lock 40. An exemplary lock 40 is a puck lock 40 which has an internal shackle which engages the shackle opening in the tang 44, when the lock is engaged.

The lock 40 receives a protruding tang 44 on either a panel 12 13 or connector frame 28. In certain configurations, the lock 40 is at least partially surrounded by a raised shroud 48 of high strength sheet metal. In certain configurations, the shroud is about 270° or greater than 270°. While the shroud 48 is shown with planar sides, it can be of other geometries such as cylindrical. The tang 44 is received with the lock 40. The lock 40 captures the tang 44 with a hasp that passes through a hole in the tang. The interior hasp that penetrates the tang is encompassed by the lock housing.

The locking system illustrated in FIGS. 13 through 15 includes a tang 44 and a puck lock 40. In this exemplary embodiment, the top panel 13 include a lock shroud 48 and puck lock 40 on one section and the protruding tang 44 on another section. The section with the tang 44 is slid into the opening in the puck lock 40 and captured by the interior hasp. The top panel 13 includes a lock shroud 48 which is dimensioned to closely encompass a perimeter of the puck lock 40. The shroud 48 is attached to a flange 15 extending from the top panel 13. FIGS. 14 and 15 show the tang in a state where it extends through the tang opening exposing the shackle opening.

Figure 4:
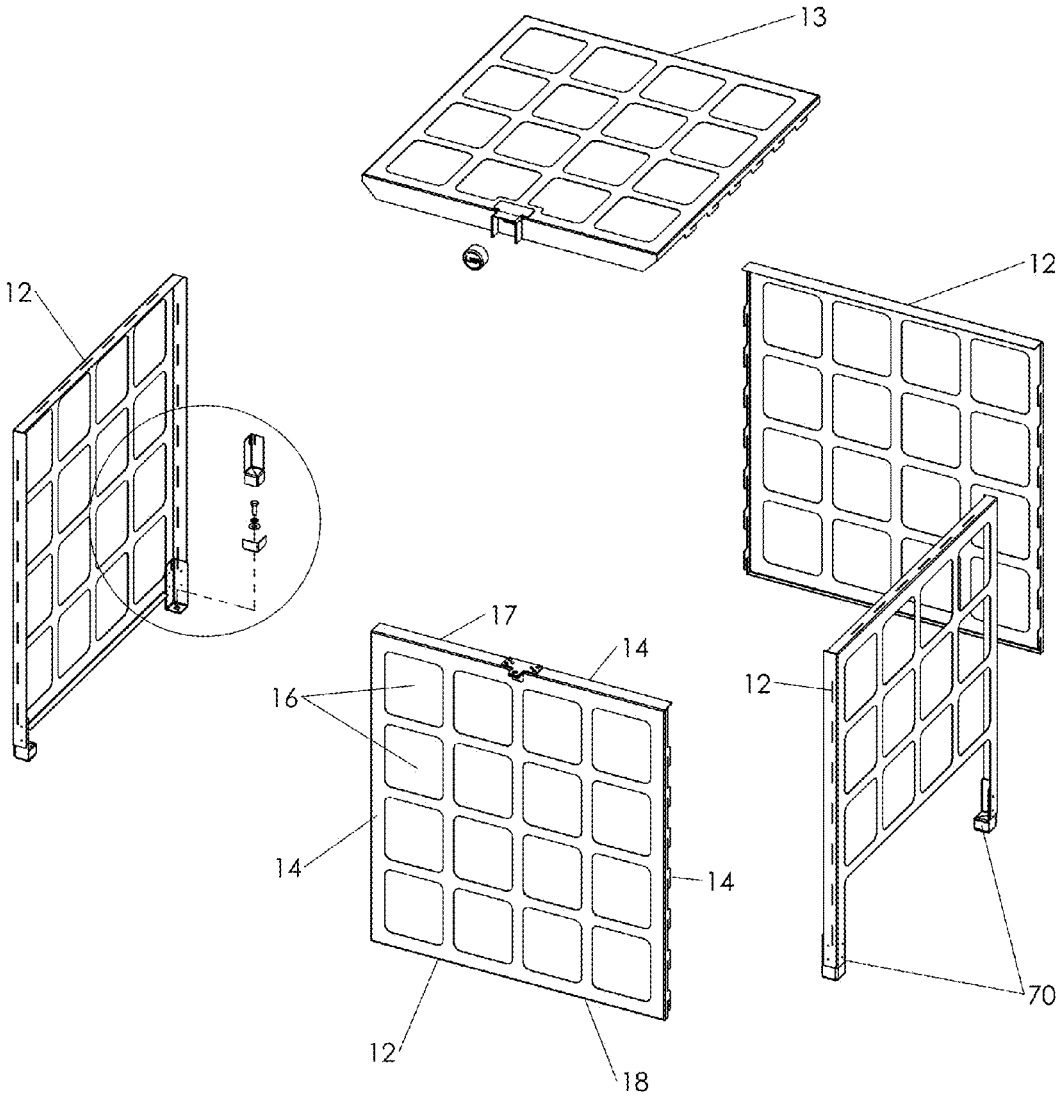
FIG. 4 is an exploded view of an alternate embodiment of a security enclosure according to the current invention.

Certain embodiments of the security enclosure include a surface mount 70, operable to retain the security enclosure 10 to the surface. In certain configurations, a leg extends downwardly from a side panel 12 or frame connector 28 and presents a face for orienting towards the surface. The face includes an opening through which a fastener 66 may be engaged in order to secure the security enclosure 10 to the surface. For example, FIG. 4 illustrates a surface mount 70 extending from a side panel 12. FIG. 5 illustrates a surface mount 70 extending from a connector frame 28. In operation, the surface mount 70 is received in holes evacuated in the surface. For additional security, the holes may then be back filled with concrete.

An alternate configuration of a surface mount 70 may be optionally employed where the surface is of insufficient size or strength or provide spacing between the equipment 04 and the surface. In the configurations shown in FIGS. 16 and 17, the surface mount 70 includes a support frame 74 extending around the lower ends 18 of the side panels 12. One or more legs 72 extend downwardly from the support frame 74 and present a face for orienting towards the surface. The face includes the opening through which the fastener 66 is engaged in order to secure the security enclosure 10 to the surface.

A threaded fastener 66 can be employed to mount the security enclosure 10 to the target surface. In certain embodiments, fastener covers 62 and fastener cover receivers 60 are provided, restricting access to the fasteners while the security enclosure 10 is in use. FIG. 4 is an exploded view of the enclosure of FIG. 1 also showing the fastener cover receiver 60, and the fastener cover 62 together with a bolt. These components are shown in greater detail in FIGS. 19 through 25.

Figure 20:
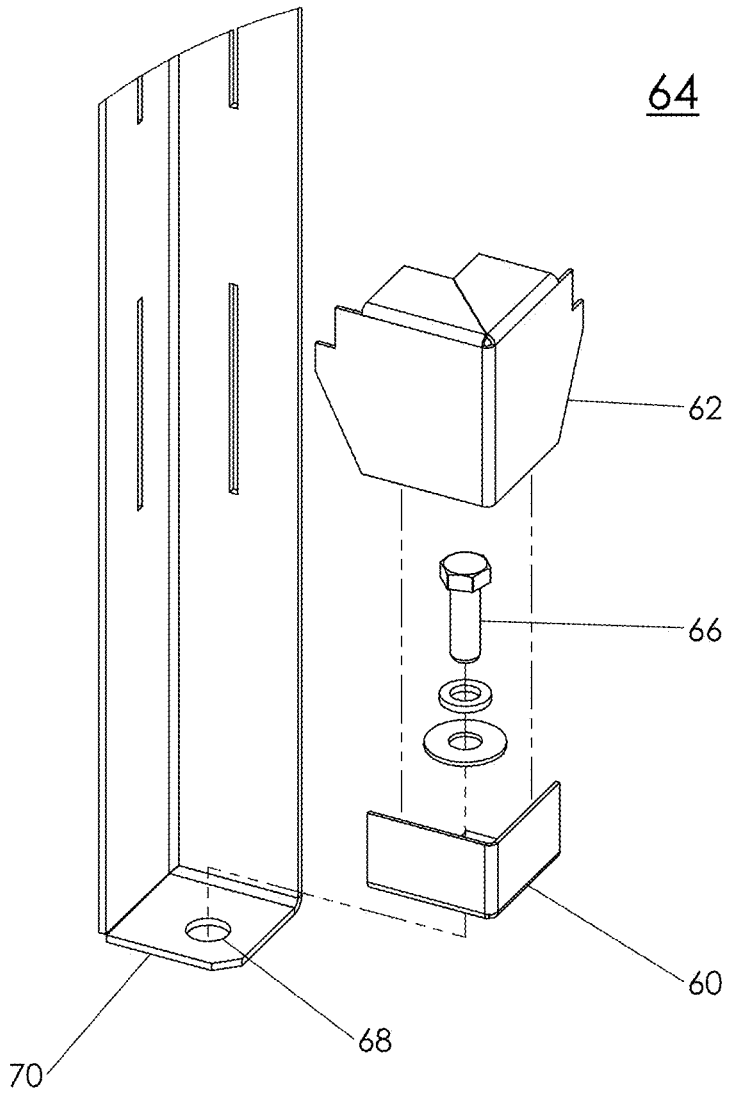
FIG. 20 shows an exploded view of a surface mount and fastener section.
Figure 21:
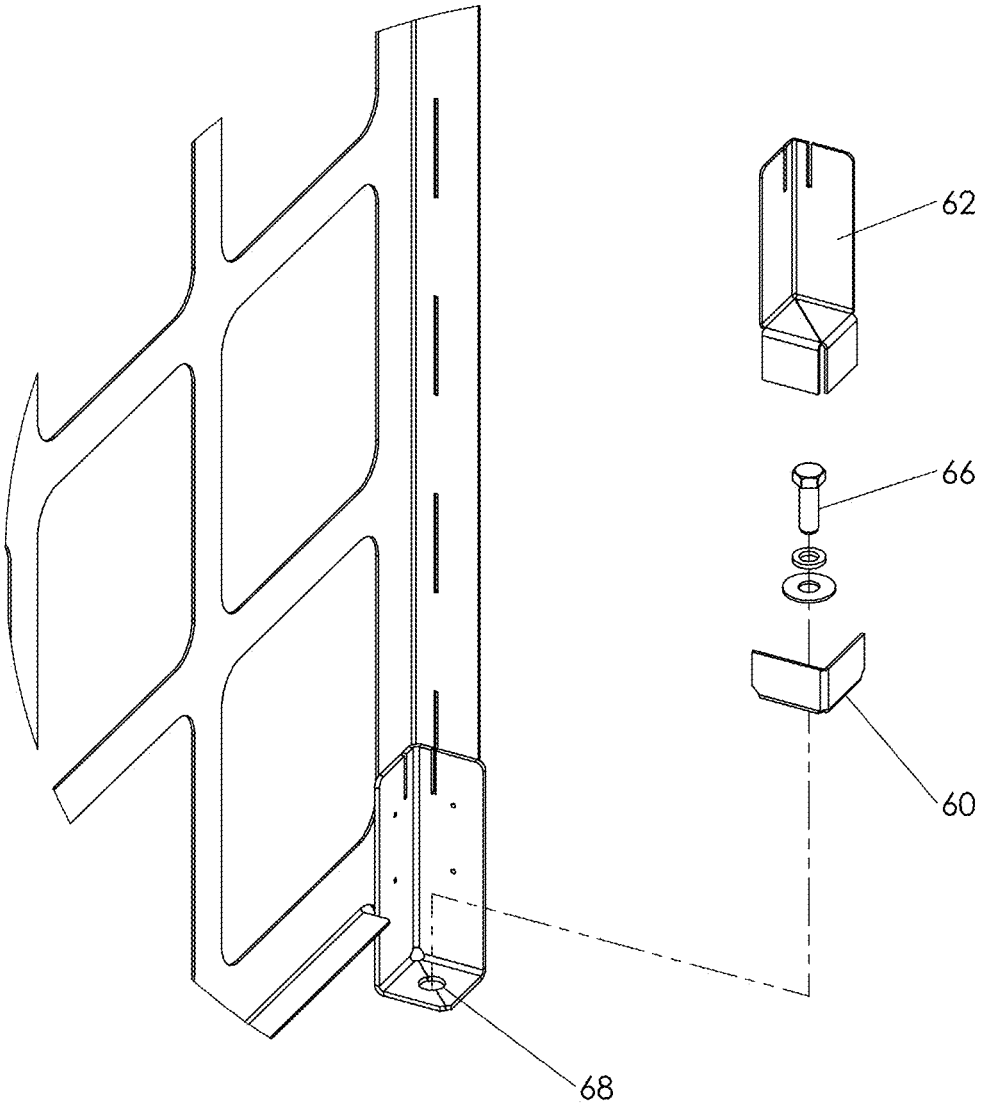
FIG. 21 shows an exploded view of a surface mount and fastener section.

FIGS. 20 and 21 show a bolt which can be received through a bolt opening in the frame and threaded into an embedded nut in the surface or employ a self-threading concrete fastener. The fastener cover receiver 60 is secured by the bolt and together with the surface mount 70, prevents access to the fastener from the sides. The fastener cover 62 has a protrusion which engages the flange on the sides (see FIG. 19) whereupon the fastener cover 62 cannot be removed without removing the side panels 12, which in turn cannot be removed without removing the top panel 13, which in turn cannot be removed because it is secured by the puck lock 40.

FIGS. 19 through 23 shows a fastener cover 62 and fastener cover receiver 60 for use with a connector frame 28 (the front facing side panel 12 has been omitted for clarity). The connector frame 28 includes an opening at its bottom through which the threaded fastener 66 is employed to mount the security enclosure 10 to the target surface.

In certain configurations, the side panels 12 have an inwardly extending horizontal flange. This flange provides extra rigidity as well as a surface against which fastener cover 62 can engage.

Figure 22:
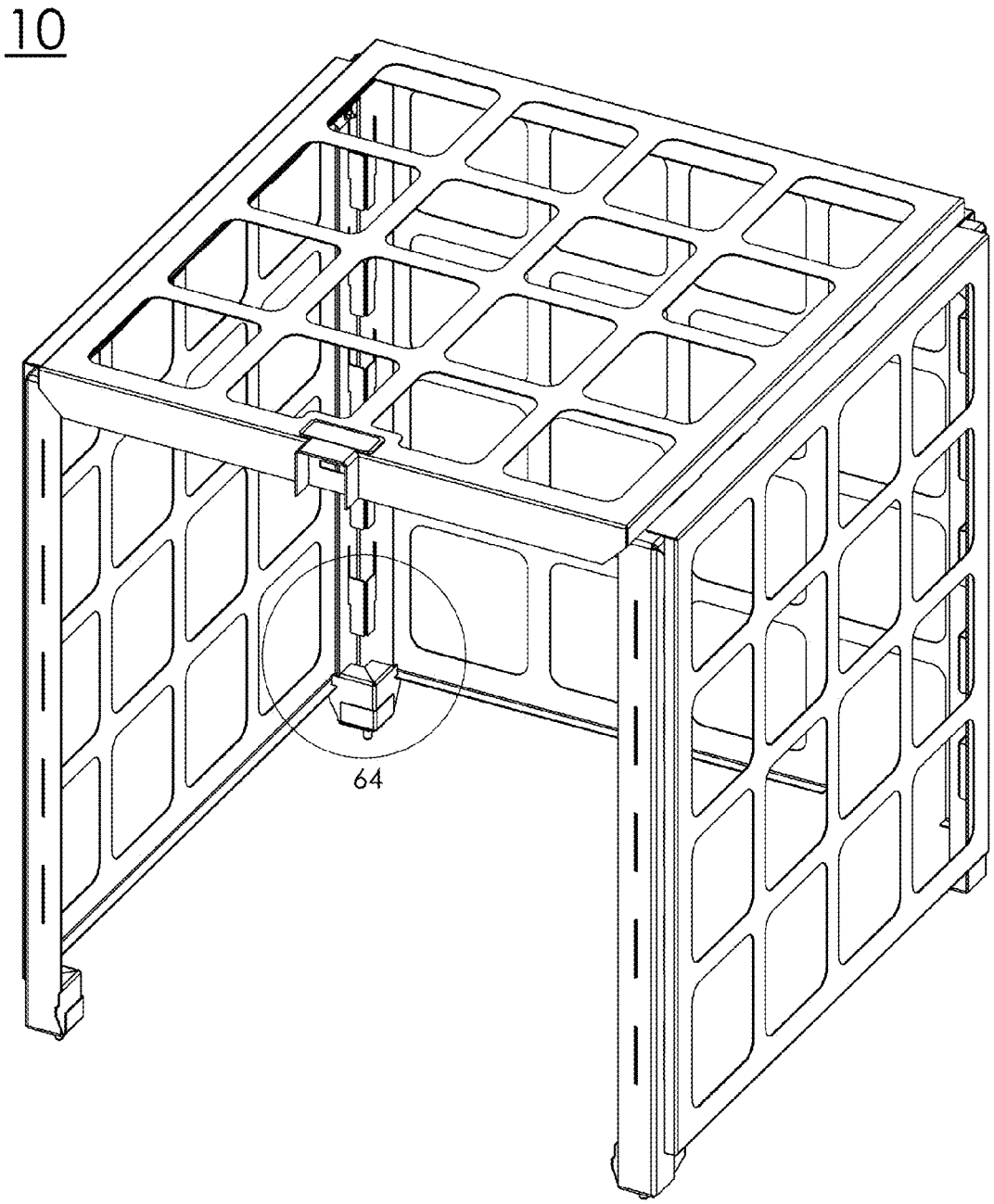
FIG. 22 shows an exploded view of a security enclosure having a fastener cover (front side panel omitted for clarity)
Figure 23:
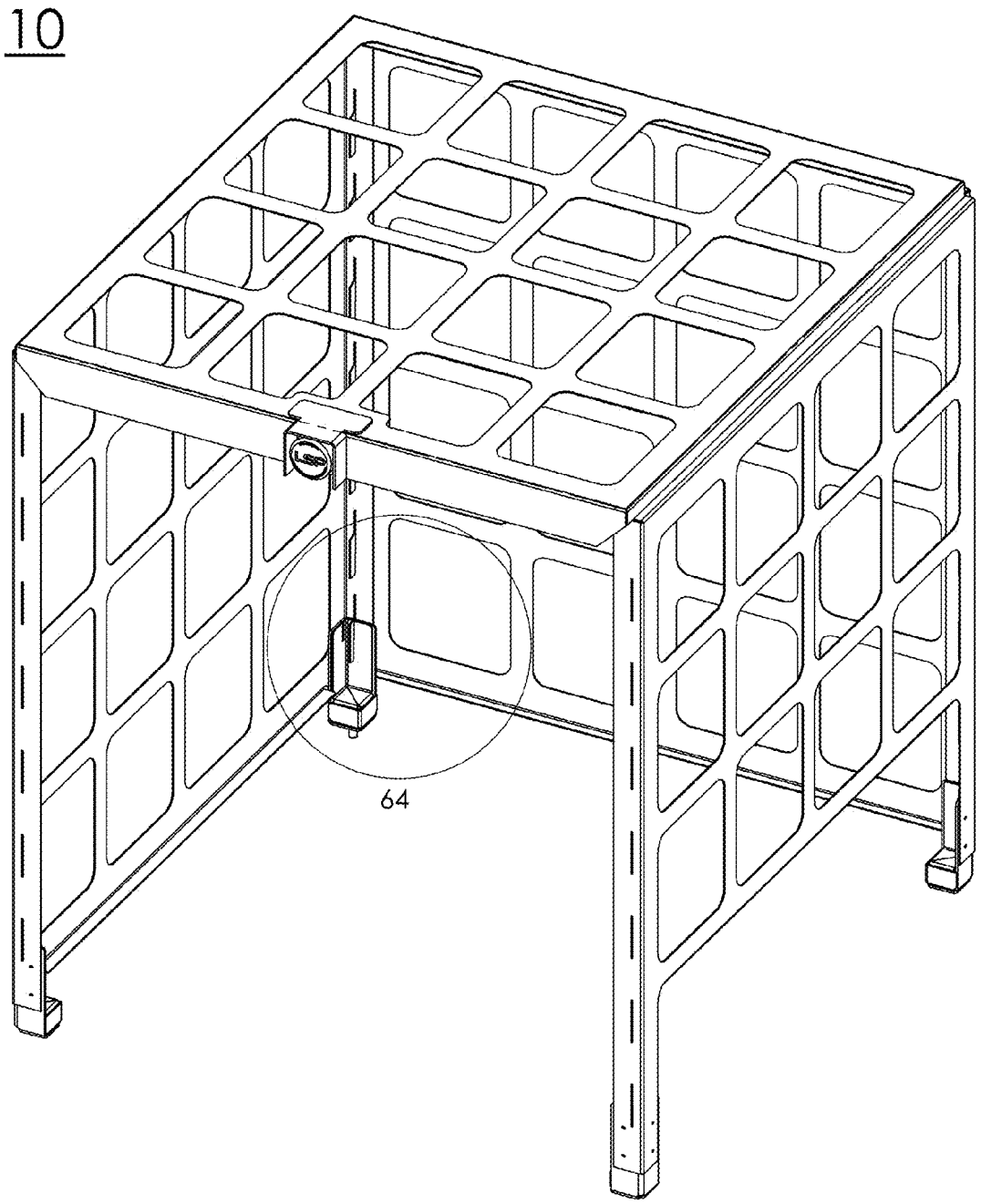
FIG. 23 shows an exploded view of a security enclosure having a fastener cover (front side panel omitted for clarity)
Figure 24:
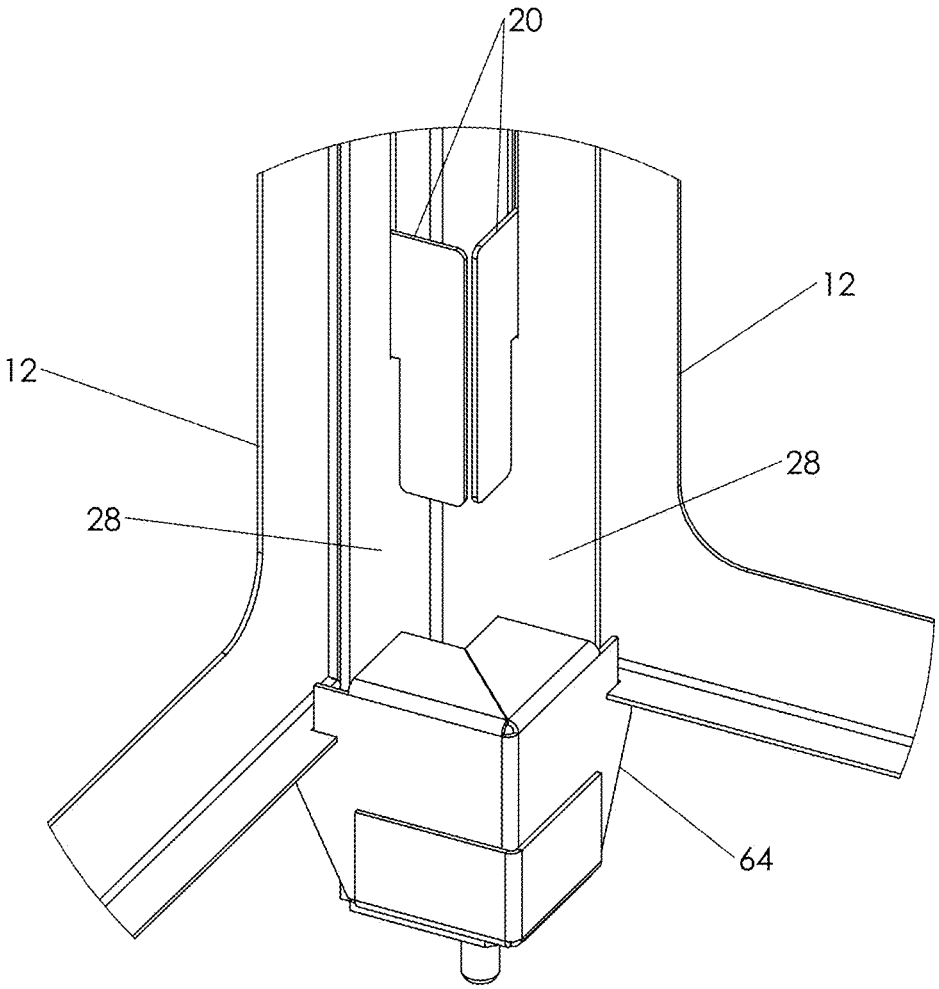
FIG. 24 shows a side perspective view of an engaged surface mount and fastener section.
Figure 25:
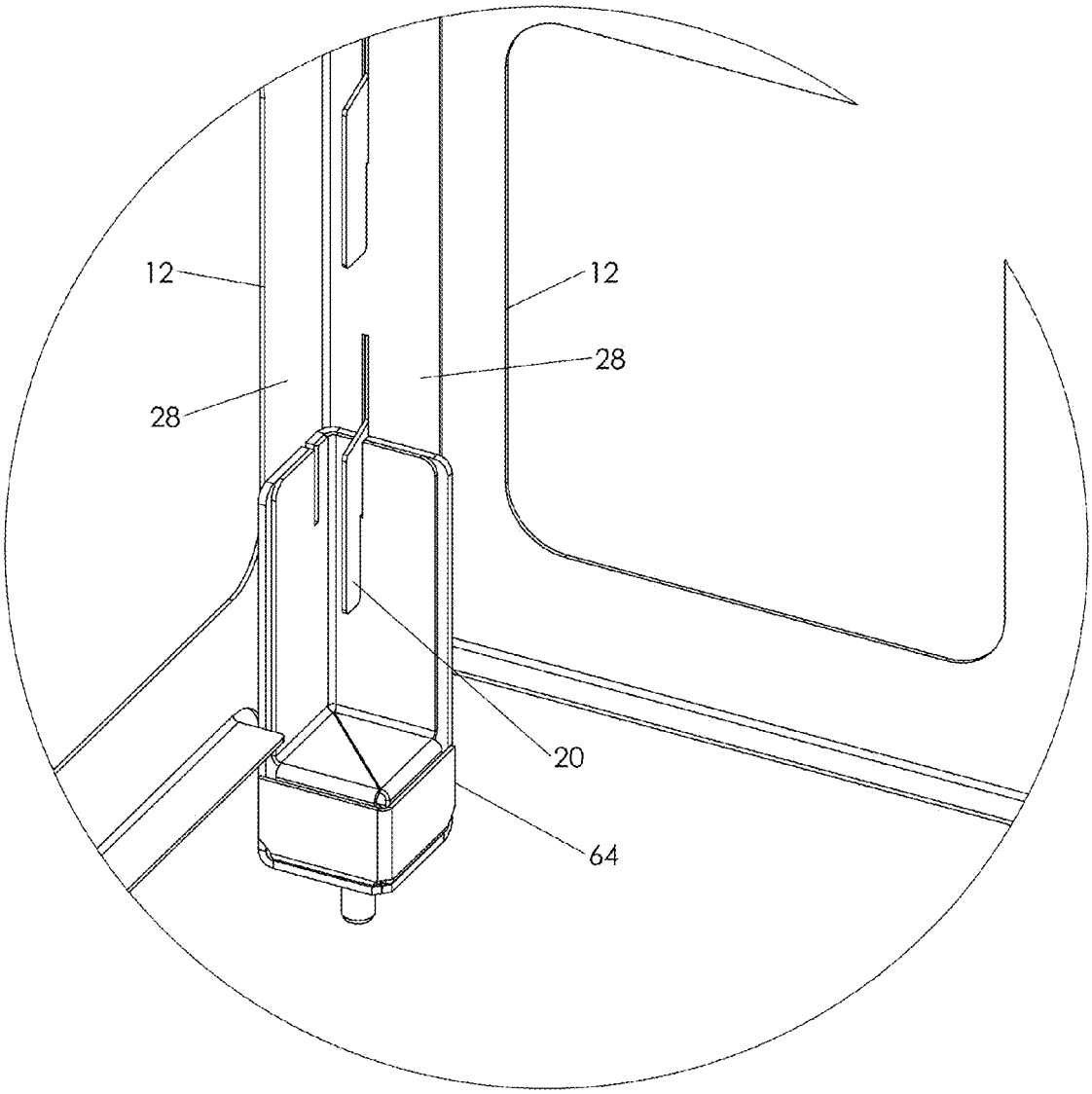
FIG. 25 shows a side perspective view of an engaged surface mount and fastener section.

FIGS. 22 and 23 show the fastener protected by the fastener cover receiver 60 and fastener cover 62. The protrusion is shown to be engaged with the flange. The fastener 66 is made inaccessible to thieves by the fastener cover 62.

In some environments, the equipment 04 is larger or elongated. In certain embodiments, such as the security enclosure of FIG. 2, the panels 12 13 of the security enclosure 10 are further comprised of joined panel sections 11. Panels sections 11 are connected together to form larger panels 12 13 and accommodate the larger equipment 04. Generally, the panel sections 13 can employ the same interconnection structures disclosed above utilized in connecting the panels 12 13 to each other.

Figure 26:
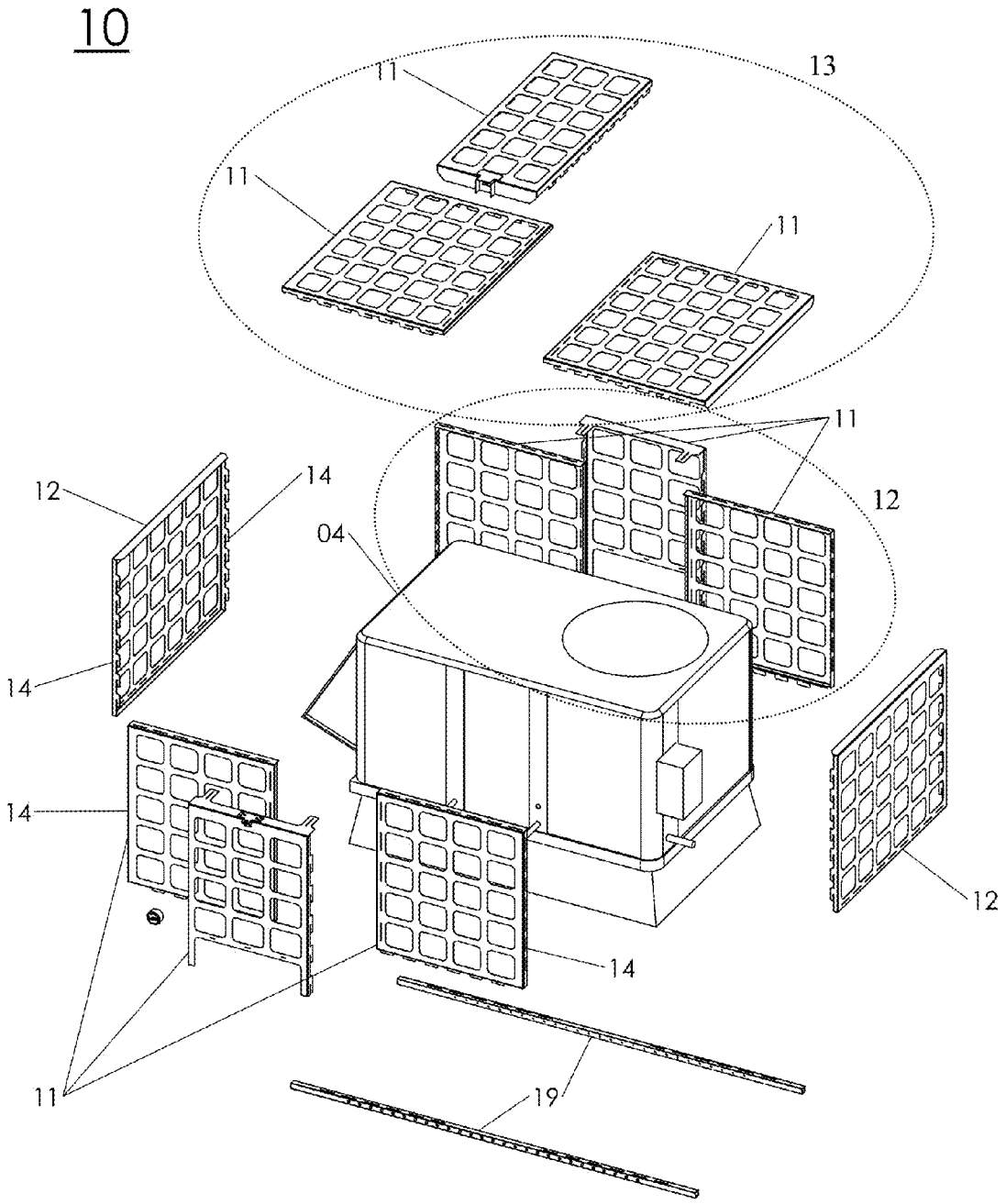
FIG. 26 is an exploded view of an embodiment of a security enclosure according to the current invention.

FIG. 26 illustrates an exploded view of an embodiment of the current invention, while FIGS. 27 through 31 illustrate the embodiment in various states of assembly. As disclosed, the panel sections 13 can employ the same interconnection structures disclosed above utilized in connecting the panels 12 13 to each other.

Figure 30:
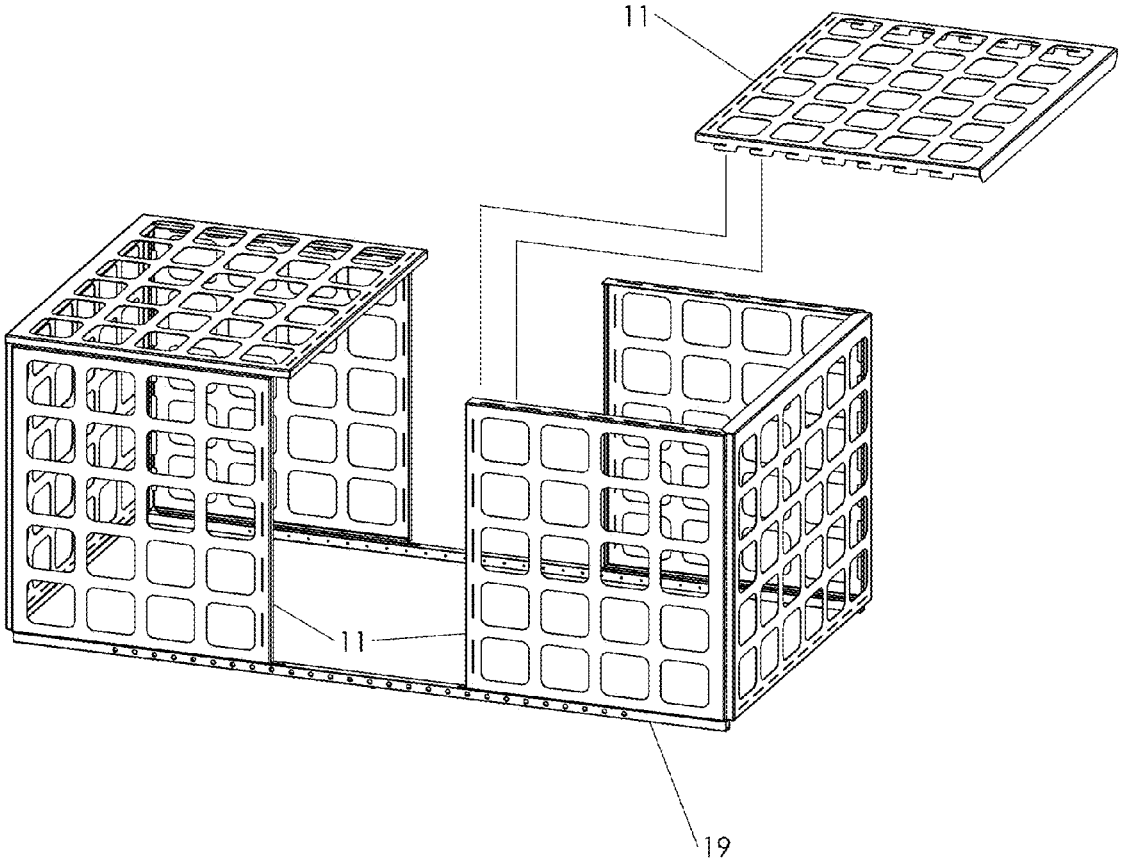
FIG. 30 is a side perspective view of the embodiment of FIG. 26 in a partially assembled state.
Figure 31:
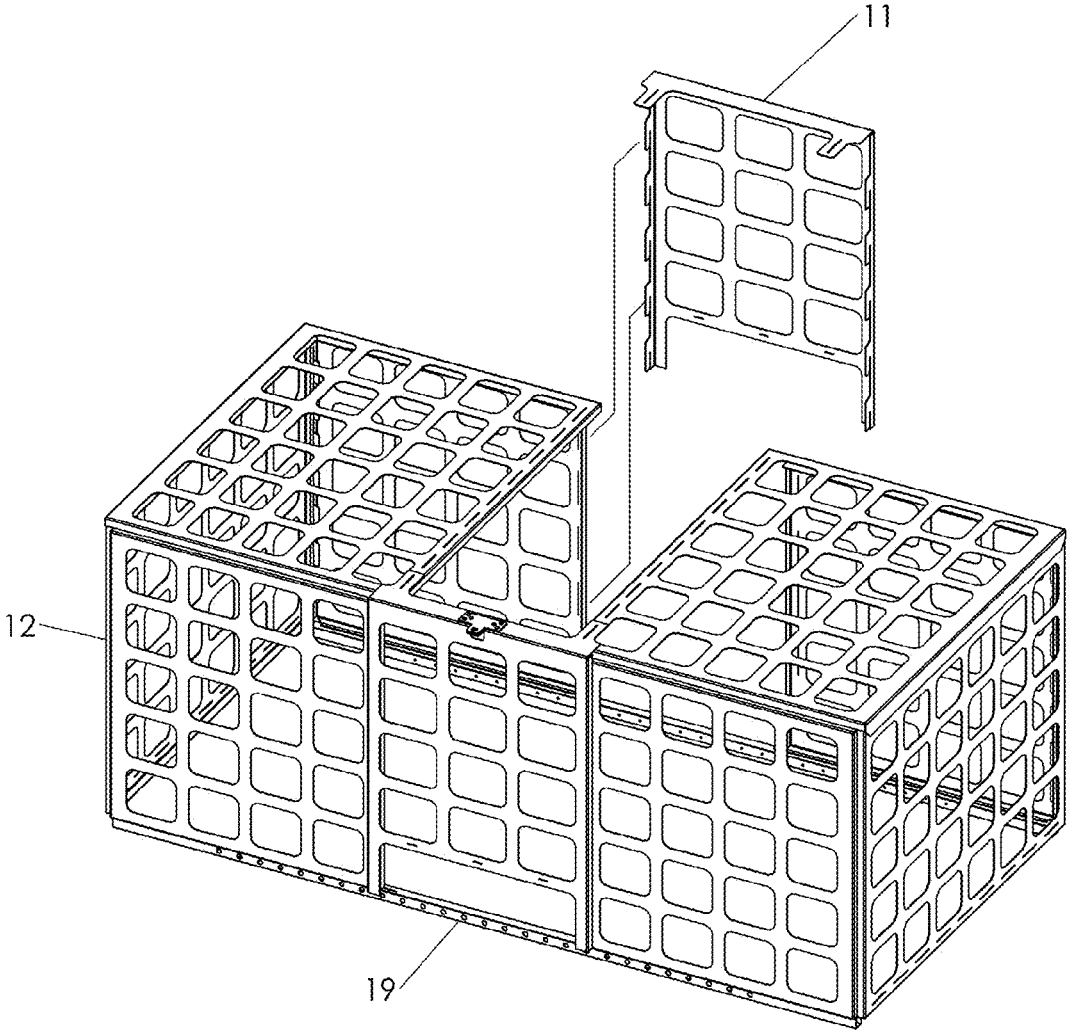
FIG. 31 is a side perspective view of the embodiment of FIG. 26 in a partially assembled state.
Figure 32:
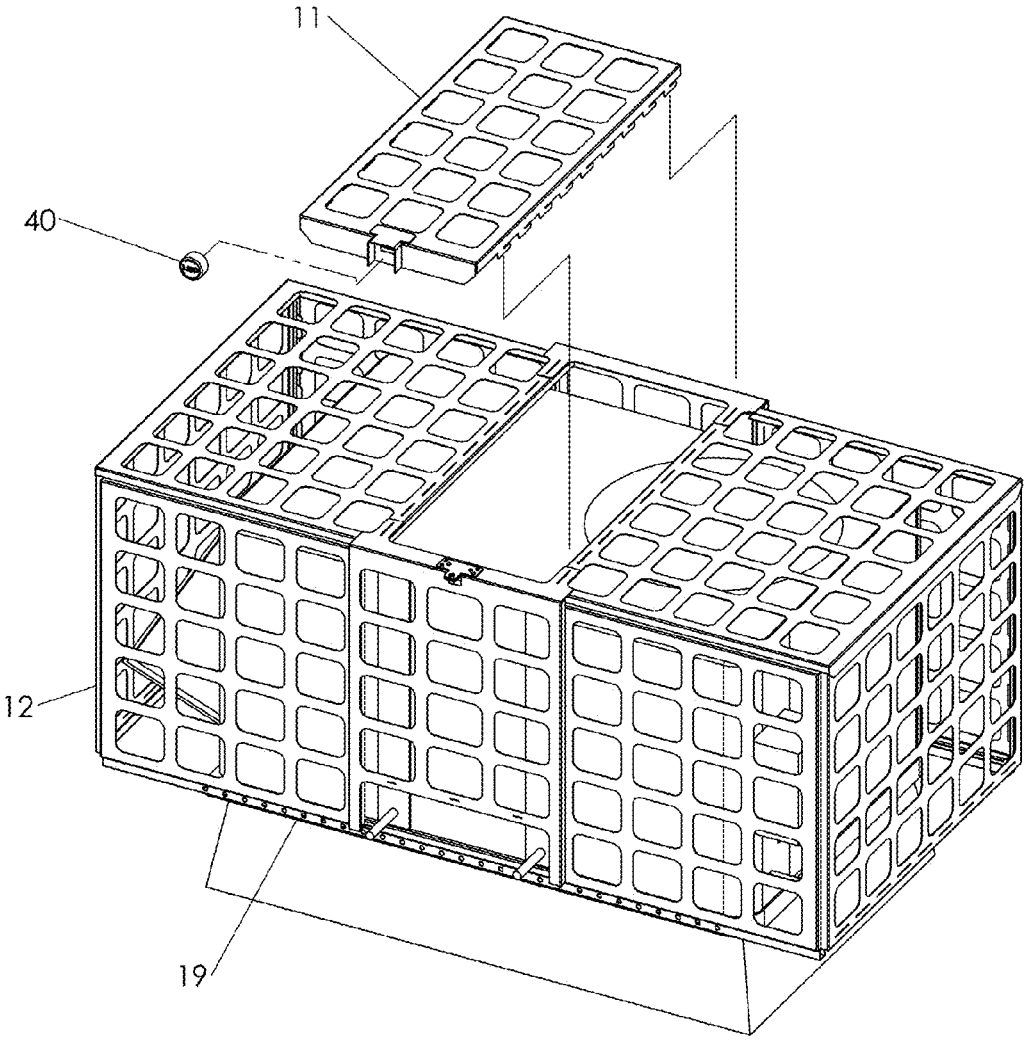
FIG. 32 is a side perspective view of the embodiment of FIG. 26 in a partially assembled state.

Certain panels 12 13 are comprised of plural panel sections 11 which further include one of the engagement protrusions 20 and engagement openings 22. The engagement protrusion 20/engagement opening 22 pairs can be L-hook 23/linear slot 27 pairs or knob hook 26/keyhole slot 28 pairs, as previously disclosed. The reciprocal portion of the engagement protrusion 20/engagement opening 22 pair is included on an adjacent panel 12 13 or panel section 13. The illustrated panel sections 11 of FIG. 27 incorporate L-hook 23/linear slot 27 pairs. In FIGS. 30 through 32, the panel sections 11 are shown in position to be engaged to each other.

Figure 27:
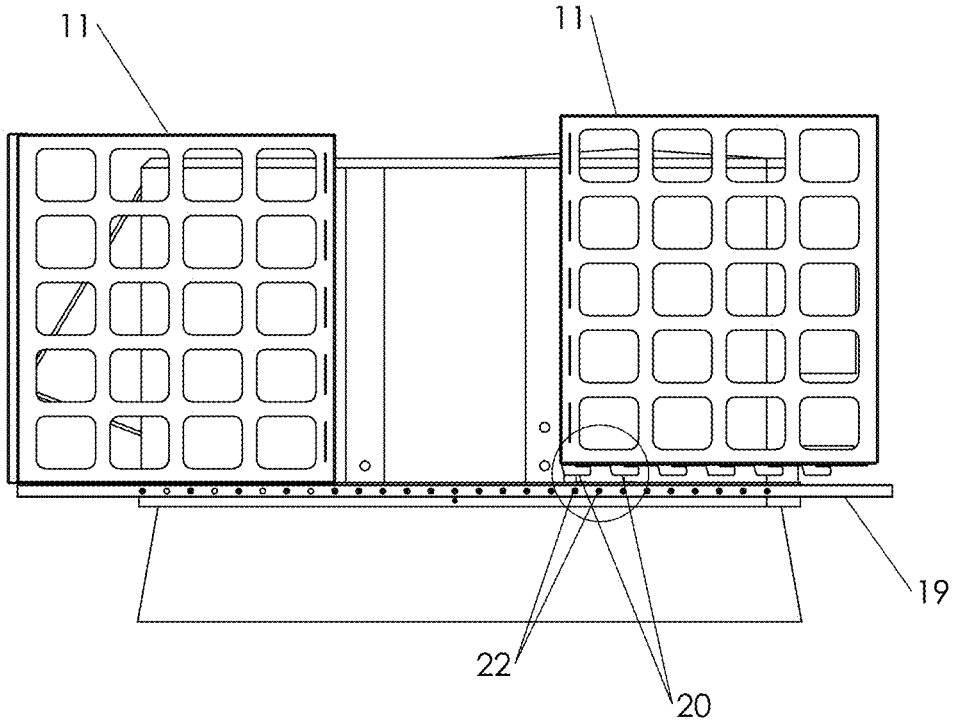
FIG. 27 is a partial side view of the embodiment of FIG. 26.
Figure 29:
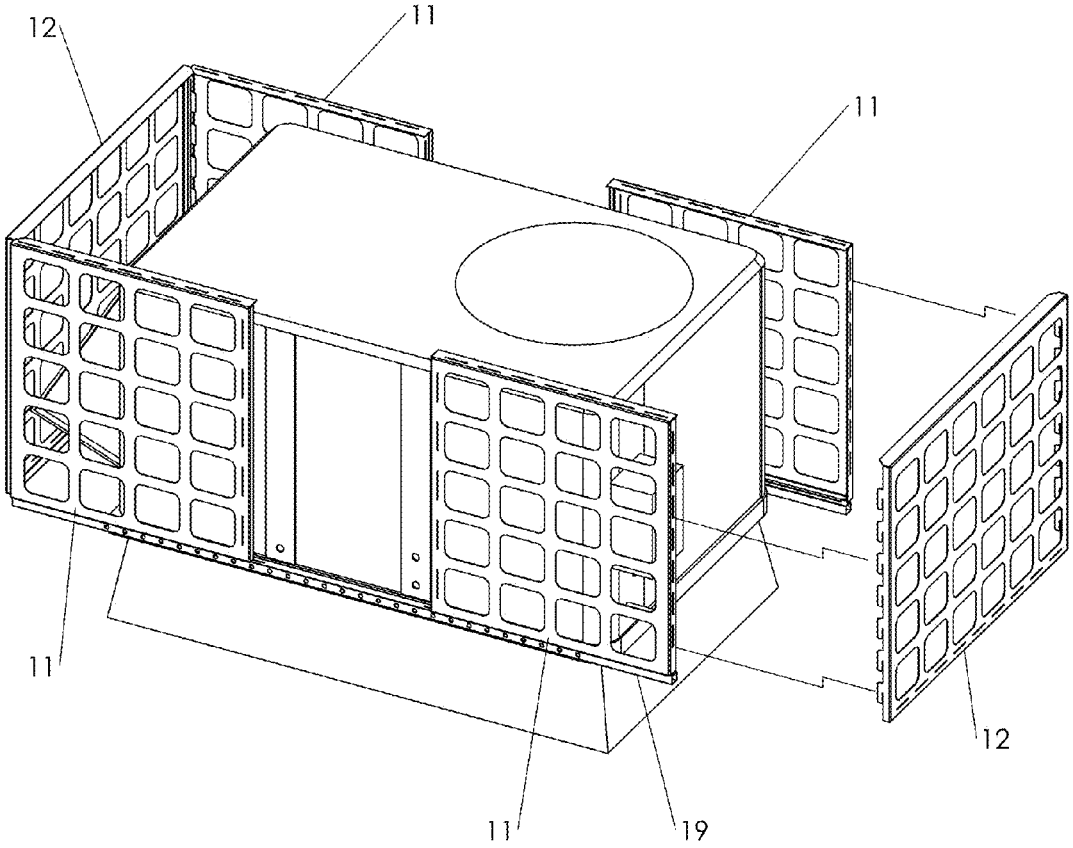
FIG. 29 is a side perspective view of the embodiment of FIG. 26 in a partially assembled state.

In certain configurations, a mounting rail 19 is provided for attachment to the surface through holes, such as those illustrated. The holes are spaced so that a plurality of the fasteners in the holes are inaccessible after the L-hook 23 are engaged with the linear slot 27 in mounting rail 19. The lower ends 18 of the panels 12 are engaged to the mounting rail 19. In FIGS. 27 and 29, side panels are shown in position to be engaged with the mounting rail 19.

Figure 28:
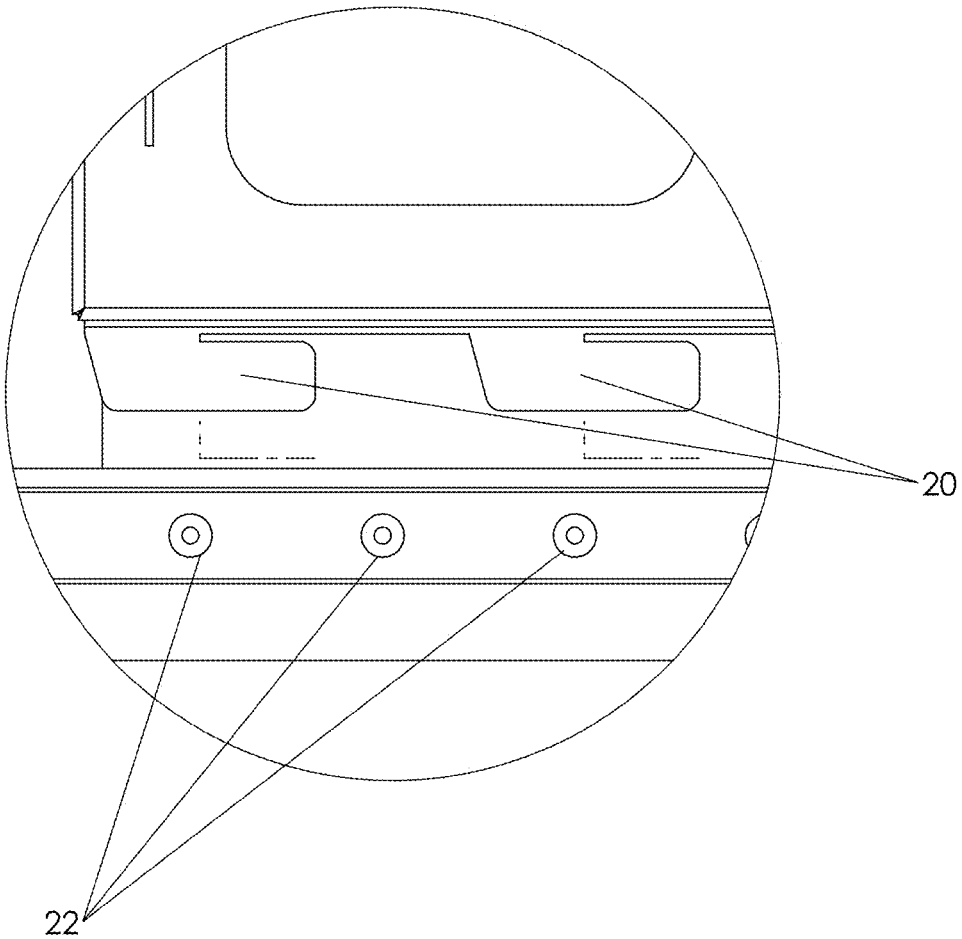
FIG. 28 is a partial side view of the embodiment of FIG. 26.

FIG. 28 shows the detail of the engagement of L-hooks 23 in mounting rails 19 preventing removal of rail fasteners. The mounting rail 19 is first secured with screws, the access to which is provided by holes. Then when the side panel 12 is lowered into position and slid, the holes are covered by the L-hook 23 so that the screws cannot be accessed.

Figure 16:
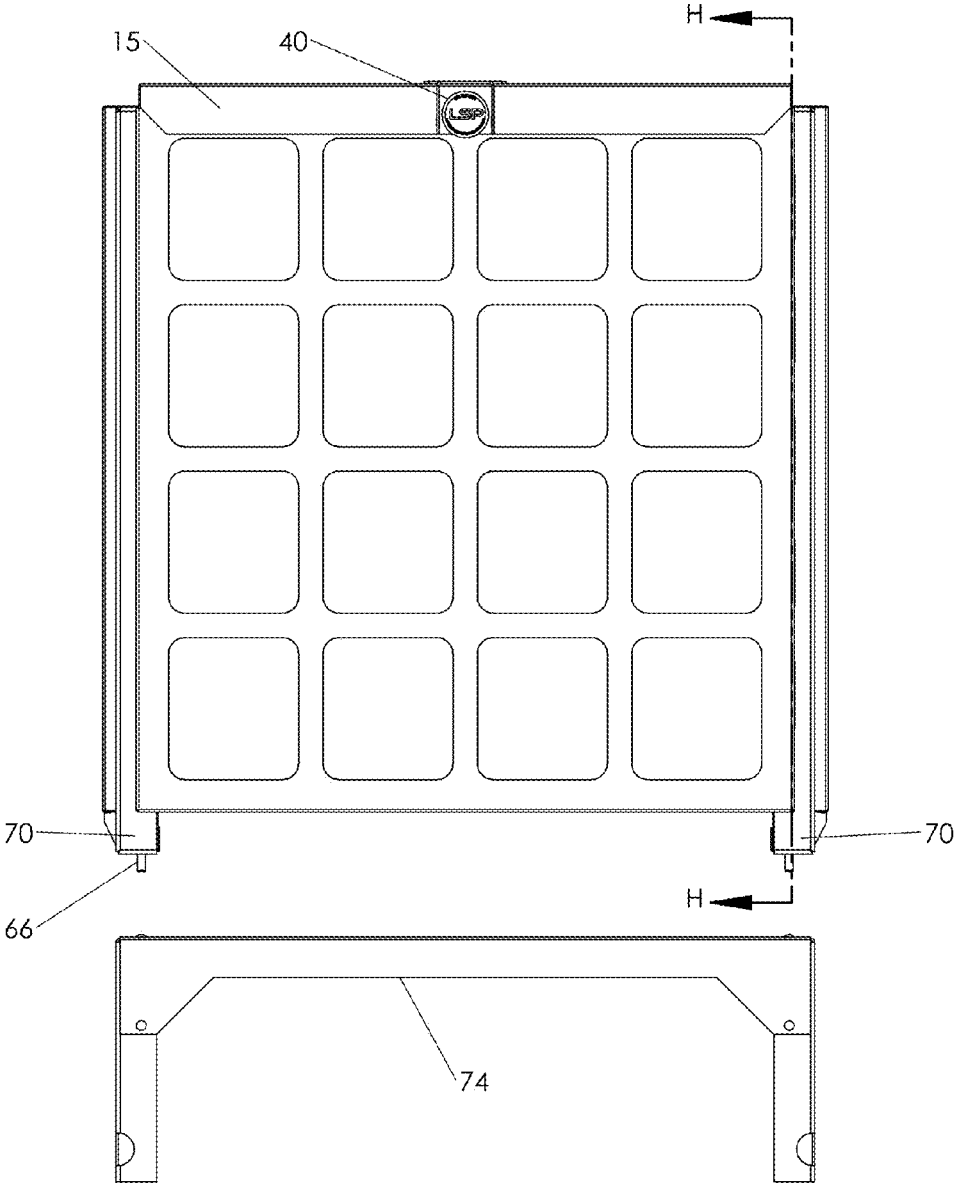
FIG. 16 is a side view of a security enclosure of according to the current invention.
Figure 17:
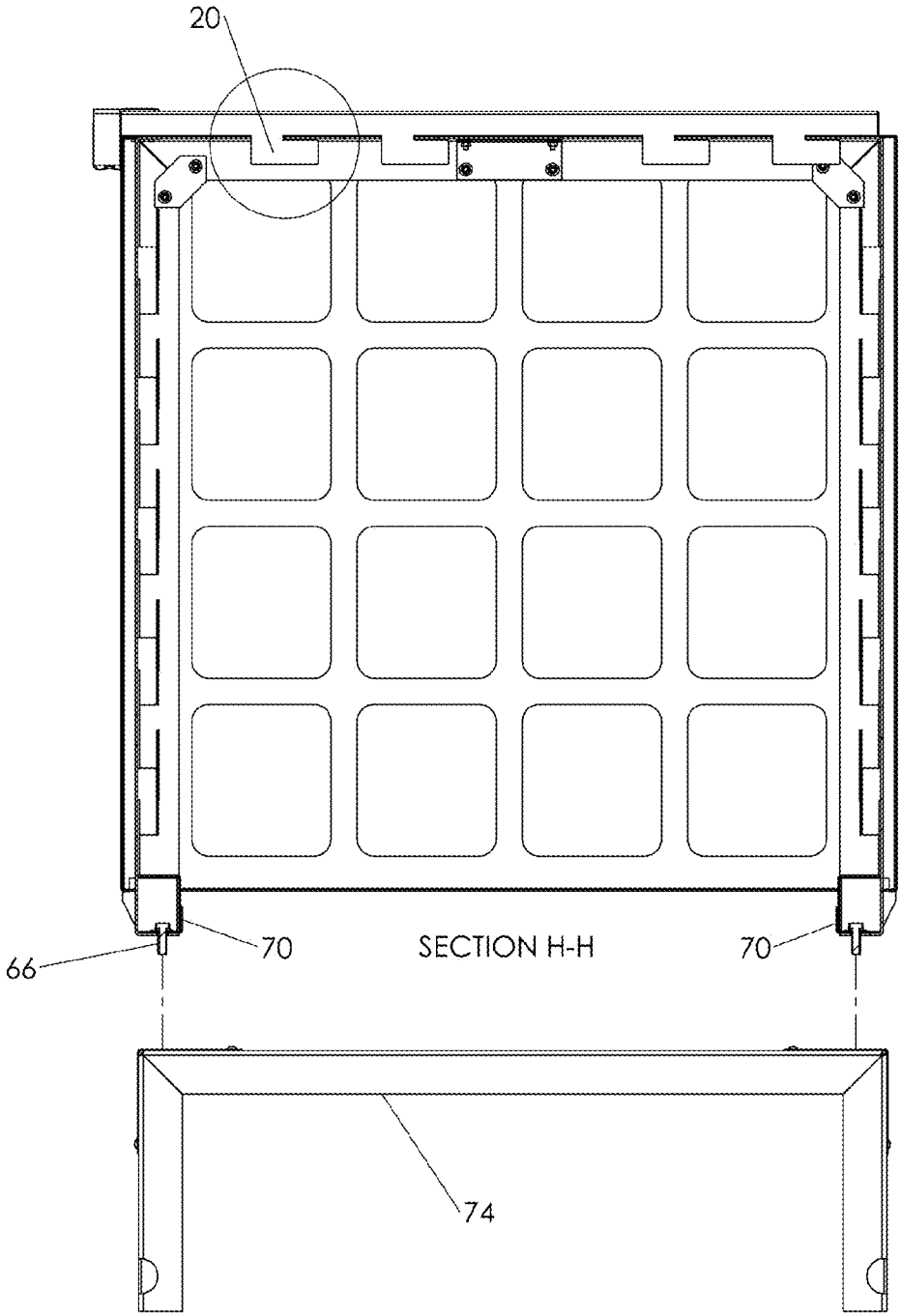
FIG. 17 is a sectional view taken along line H-H of FIG. 16.
Figure 18:
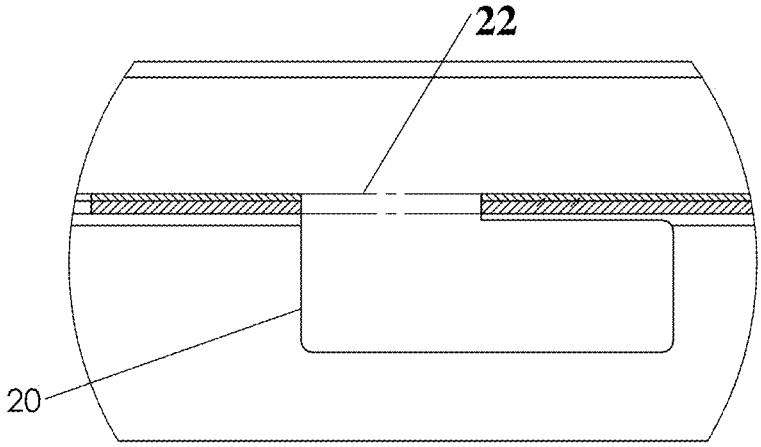
FIG. 18 shows an engagement protrusion to engagement opening cross-section.
Figure 19:
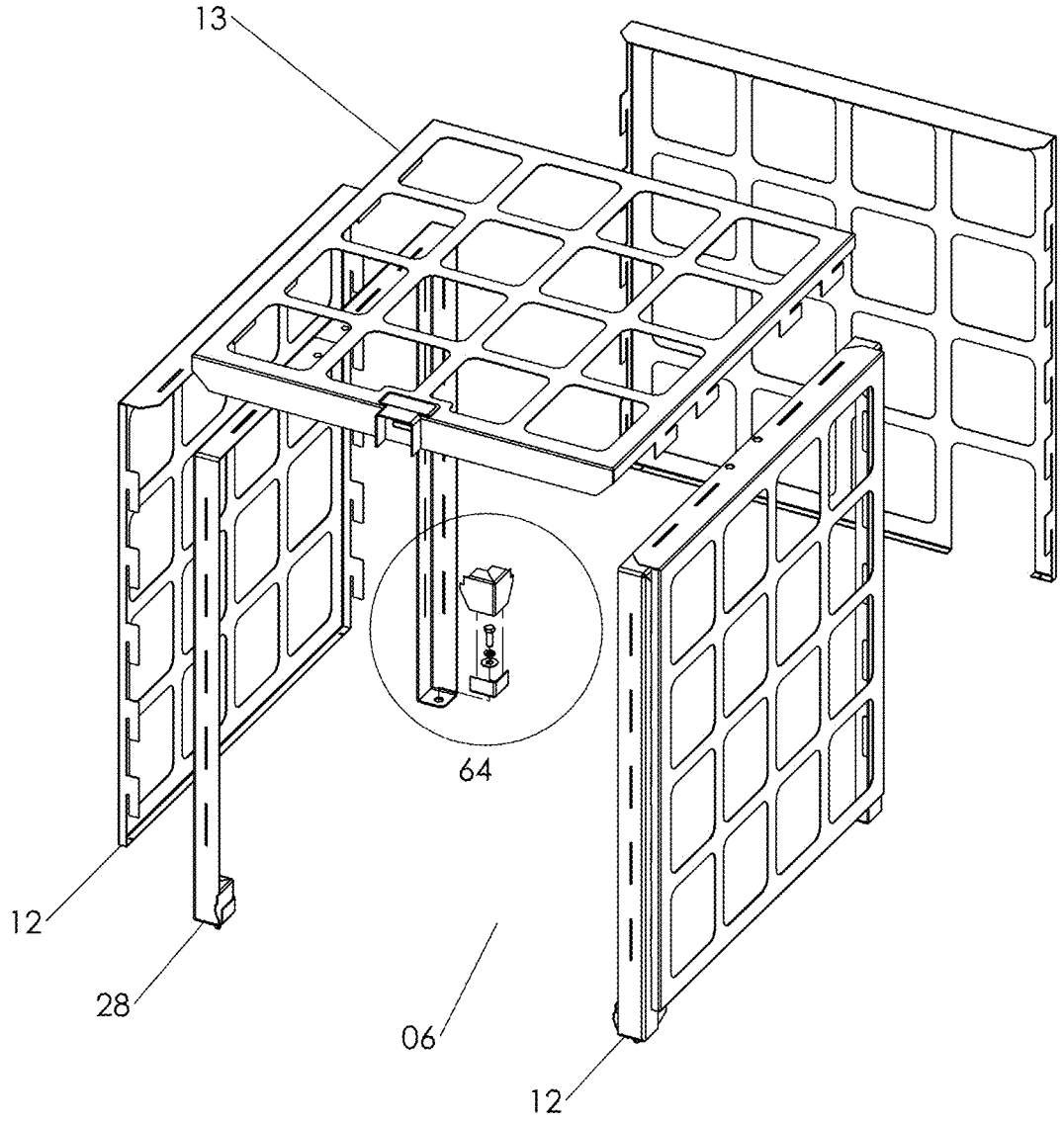
FIG. 19 shows an exploded view of a security enclosure having a fastener cover (front side panel omitted for clarity)

Having disclosed elements of embodiments of the current invention, example assembly and use is disclosed. In operation of an embodiment of the device, a first side panel 12 and connector frame 28 are presented (FIG. 5). As shown, it's L-hooks 23 are oriented toward the linear slots 27 on a first face 34 of the connector frame 28. The first side panel 12 is moved horizontally to slide the L-hooks 23 through the linear slots 27 and then vertically in order to secure the first side panel 12 to the connector frame 28. FIG. 8 shows L-hooks 23 slidably engaged through the linear slots 27. The L-hooks 23 of a second side panel 12 are oriented toward the linear slots 27 on the second face 35 of the connector frame 28. The second side panel 12 is moved horizontally to slide the L-hooks 23 through the linear slots 27 and then vertically in order to secure the second side panel 12 to the connector frame 28. At this stage, the first side panel 12 and second side panel are secured to each and cannot move horizontally relative to each other. Remaining side panels 12 are joined to form a perimeter. At this stage, the side panels 12 are secured to each and cannot move horizontally relative to each other. One of the side panels 12 includes a tang 44 with a shackle opening, with the tang extending outwardly (FIG. 11). A top panel 13 is presented (FIG. 11). As shown above, its L-hooks 23 are oriented toward the linear slots 27 of the upper ends 17 of the side panels 12. The top panel 13 is moved vertically to slide its L-hooks 23 through the linear slots 27 and then horizontally in order to secure the top panel 13 to the side panels 13 (FIG. 12, FIG. 17), while leaving the tang extending through an opening in the top panel 13 (FIG. 15). At this stage, relative motion of any of the panels 12 13 to each other is restricted. A lock 40 is engaged to the tang 44 and the shackle of the lock 40 is placed through the shackle opening of the tang 44 (FIG. 16). At this point, relative motion of any of the panels 12 13 to each other is secured. Surface mounts 70 are oriented toward the surface, leaving the bolt opening 68 exposed (FIG. 20). A fastener cover receiver 60 is placed at the bolt opening 68, leaving the bolt opening 68 exposed (FIG. 20). A fastener 66 is placed through the bolt opening 68 and surface (FIG. 20). The fastener cover 62 is secured to the fastener cover receiver 62 (FIG. 20), resulting in the enclosed, retained security enclosure 10 (FIG. 23, front side side panel omitted for visual clarity).

Insofar as the description above and the accompanying drawing disclose any additional subject matter that is not within the scope of the single claim below, the inventions are not dedicated to the public and the right to file one or more applications to claim such additional inventions is reserved.

What is claimed is:

1. A theft deterrent enclosure comprising:

a top panel and at least two side panels;

each of said side panels having an upper portion, a lower portion, and two opposing side edges;

at least one of said side panels having a plurality of openings to allow the passage of air through said panel;

each of said side panels having engagement protrusions along its first side edge and having reciprocal engagement openings along its opposing second side edge, wherein said engagement protrusions of the first side panel permit insertion and slidable engagement to said engagement openings of the second side panel;

said engagement protrusions and said reciprocal engagement openings selected from the following:

said engagement protrusions comprise L-shaped hooks and said reciprocal engagement openings comprise linear slots, said L-shaped hooks having a first section extending outwardly from said side panel and a second section angularly depending from said first section; and said engagement protrusions comprise knob hooks and said reciprocal engagement opening comprise keyhole slots, said knob hooks having a first section of a first width extending outwardly from said side panel and a second section of said knob hooks flaring to a second greater width; said keyhole slots having a first slot section of a width greater than said flared second section of the knob hook and an adjacent second more narrow section;

each of said side panels having one of engagement protrusions or engagement openings along its upper portion, said top panel having the reciprocal engagement protrusions or engagement openings along its edge, wherein said engagement protrusions permit insertion and slidable engagement to said engagement openings, securing said top panel to the upper portions of each of said side panels;

a tang extending from at least one of said side panels, said tang having a shackle opening, an opening in said top panel permitting insertion of said tang therethrough, whereby a shackle of a lock inserted through said shackle opening restricts relative motion of said top panel and said side panels.

2. The theft deterrent enclosure according to claim 1, further comprising:

a plurality of legs extending downwardly from a side panel and presenting faces for orientation downwardly, each of said faces having an opening;

a plurality of fasteners dimensioned to slideably engage through said openings in order to secure said side panels to a surface.

3. The theft deterrent enclosure according to claim 2, further comprising: a plurality of fastener covers positioned to bar access to said fasteners to prevent removal of said fasteners covers after said fasteners are tightened.

4. The theft deterrent enclosure according to claim 1, further comprising: a shroud closely surrounding said shackle opening.

5. The theft deterrent enclosure according to claim 4, wherein:

said shroud is comprised of upraised metal closely surrounding said shackle opening and forming a perimeter of about 270 degrees or greater.

6. The theft deterrent enclosure according to claim 1, wherein: said side panels are comprised of sheet metal.

7. The theft deterrent enclosure according to claim 1, further comprising a plurality of spaced apart legs extending downwardly from said lower portion of said side panels.

8. The theft deterrent enclosure according to claim 1, further comprising a lock having no external hasp.

9. The theft deterrent enclosure of claim 1, further comprising:

a lock having an opening to receive and engage said tang, dimensioned to be received within a lock shroud.

10. The theft deterrent enclosure of claim 6, wherein:

said sheet metal comprises sheet steel.

11. A theft deterrent enclosure comprising:

a top panel and at least two side panels;

each of said side panels having an upper portion, a lower portion, and two opposing side edges;

at least one of said side panels having a plurality of openings to allow the passage of air through said panel;

a first of said side panels having one of inwardly facing engagement protrusions or engagement openings along its first side edge;

said engagement protrusions comprise L-shaped hooks and said engagement openings comprise linear slots, said L-shaped hooks having a first section extending outwardly from said side panel and a second section angularly depending from said first section;

a second of said side panels having the reciprocal interfitting portion of engagement protrusions or engagement openings to said first edge of said first panel along its first side edge, wherein said side panel having said engagement protrusions permit insertion and slidable engagement to said engagement openings of another of said side panels having said engagement openings;

each of said side panels having one of engagement protrusions or engagement openings along its upper portion, said top panel having the reciprocal interfitting portion of engagement protrusions or engagement openings along its edge, wherein said engagement protrusions permit insertion and slidable engagement to said engagement openings, securing said top panel to the upper portions of each of said side panels;

a tang extending from at least one of said side panels, said tang having a shackle opening, an opening in said top panel permitting insertion of said tang therethrough, whereby a shackle of a lock inserted through said shackle opening restricts relative motion of said top panel and said side panels.

12. The theft deterrent enclosure according to claim 11, further comprising:

a plurality of legs extending downwardly from a side panel and presenting faces for orientation downwardly, each of said faces having an opening;

a plurality of fasteners dimensioned to slideably engage through said openings in order to secure said side panels to a surface.

13. A theft deterrent enclosure comprising:

a top panel, at least two side panels, and a connector frame, said connector frame for interposition between adjacent side panels, bridging said adjacent side panels;

each of said side panels having an upper portion, a lower portion, and two opposing side edges;

at least one of said side panels having a plurality of openings to allow the passage of air through said panel;

said connector frame including one of engagement protrusions or engagement openings on a first face and reciprocal engagement protrusions or engagement openings on a second face;

said engagement protrusions and reciprocal engagement openings selected from the following:

said engagement protrusions comprise L-shaped hooks and said reciprocal engagement openings comprise linear slots, said L-shaped hooks having a first section extending outwardly from said connector frame and a second section angularly depending from said first section; and said engagement protrusions comprise knob hooks and said reciprocal engagement openings comprise keyhole slots, said knob hooks having a first section of a first width extending outwardly from said connector frame and a second section of said knob hooks flaring to a second greater width; said keyhole slots having a first slot section of a width greater than said flared second section of the knob hook and an adjacent second more narrow section;

a first of said side panels having the reciprocal inter-fitting portion of engagement protrusions or engagement openings to said first face of said connector frame along its first side edge, wherein said engagement protrusions permit insertion and slidable engagement to said engagement openings;

a second of said side panels having the reciprocal inter-fitting portion of engagement protrusions or engagement openings to said second face of said connector frame along its first side edge, wherein said engagement protrusions permit insertion and slidable engagement to said engagement openings;

each of said side panels having one of engagement protrusions or engagement openings along its upper portion, said top panel having the reciprocal inter-fitting portion of engagement protrusions or engagement openings along its edge, wherein said engagement protrusions permit insertion and slidable engagement to said engagement openings, securing said top panel to the upper portions of each of said side panels;

a tang extending from at least one of said side panels, said tang having a shackle opening, an opening in said top panel permitting insertion of said tang therethrough, whereby a shackle of a lock inserted through said shackle opening restricts relative motion of said top panel and said side panels.

14. The theft deterrent enclosure according to claim 13, further comprising:

a plurality of legs extending downwardly from a side panel and presenting faces for orientation downwardly, each of said faces having an opening;

a plurality of fasteners dimensioned to slideably engage through said openings in order to secure said side panels to a surface.

* * * * *